US009725272B2

(12) United States Patent
Kimura et al.

(10) Patent No.: US 9,725,272 B2
(45) Date of Patent: Aug. 8, 2017

(54) PAPER POST-PROCESSING DEVICE

(71) Applicant: GRADCO JAPAN LTD., Shinagawa-ku, Tokyo (JP)

(72) Inventors: Kuniaki Kimura, Tokyo (JP); Kenichi Watanabe, Tokyo (JP)

(73) Assignee: GRADCO JAPAN LTD., Shinagawa-ku, Tokyo (JP)

( * ) Notice: Subject to any disclaimer, the term of this patent is extended or adjusted under 35 U.S.C. 154(b) by 0 days.

(21) Appl. No.: 14/911,950

(22) PCT Filed: May 29, 2014

(86) PCT No.: PCT/JP2014/064322
§ 371 (c)(1),
(2) Date: Feb. 12, 2016

(87) PCT Pub. No.: WO2015/022801
PCT Pub. Date: Feb. 19, 2015

(65) Prior Publication Data

US 2016/0194172 A1 Jul. 7, 2016

(30) Foreign Application Priority Data

Aug. 15, 2013 (JP) ..... 2013-168887
Jan. 15, 2014 (JP) ..... 2014-004819

(51) Int. Cl.
*B65H 29/28* (2006.01)
*B65H 31/30* (2006.01)
(Continued)

(52) U.S. Cl.
CPC ..... *B65H 31/3045* (2013.01); *B65H 29/28* (2013.01); *B65H 31/3081* (2013.01);
(Continued)

(58) Field of Classification Search
CPC B65H 31/3036; B65H 31/3045; B65H 31/34; B65H 31/3081; B65H 29/28
See application file for complete search history.

(56) References Cited

U.S. PATENT DOCUMENTS 7,487,959 B2 * 2/2009 Noh ..... G03B 27/00 198/484.1
9,132,981 B2 * 9/2015 Lee ..... B65H 31/3054

FOREIGN PATENT DOCUMENTS

JP 06-166456 A 6/1994
JP 2003-089464 A 3/2003
JP 2008-273659 A 11/2008

OTHER PUBLICATIONS

International Search Report for PCT/JP2014/064322, mailed Sep. 30, 2014 (3 pgs.).

* cited by examiner

*Primary Examiner* — Jeremy R Severson
(74) *Attorney, Agent, or Firm* — Flynn, Thiel, Boutell & Tanis, P.C.

(57) ABSTRACT

A paper post-processing device includes: a base tray 112 configured to stack paper transferred from an image-forming device; a paper transferring unit including a paper gripper configured to grip a rear end of a paper bundle stacked on the base tray 112, a paper transferring unit configured to transfer the paper gripper; and a stacker tray 103 configured to stack paper transferred from the paper transferring unit, wherein the paper gripper includes an ejector 202 to be fixed, and a gripper 106 rotatably configured about a predetermined angle to the ejector 202, and the paper gripper is configured to grip the several sheets of paper by the ejector 202 and the gripper 106, further including a grip release unit configured to release a grip by the ejector 202 and the gripper 106.

4 Claims, 48 Drawing Sheets

(51) Int. Cl.
*B65H 31/38* (2006.01)
*B65H 31/34* (2006.01)

(52) U.S. Cl.
CPC ..... *B65H 31/34* (2013.01); *B65H 31/38* (2013.01); *B65H 2301/4212* (2013.01); *B65H 2301/4213* (2013.01); *B65H 2404/1114* (2013.01); *B65H 2404/693* (2013.01); *B65H 2405/11164* (2013.01); *B65H 2801/27* (2013.01)

(a)

(b)

PAPER POST-PROCESSING DEVICE

TECHNICAL FIELD

The present invention relates to a paper post-processing device connected to a digital output device (for example, a copying machine and a printer) and configured to arrange sheets of paper to stack. In particular, the present invention relates to a paper stacking in the paper post-processing device that enables sheets of paper to stack in an orderly unchanged condition on a stacker tray configured to house the paper to stack while moving vertically.

BACKGROUND ART

Typically, an image-forming device such as a copying machine or a printer includes the function of stapling sheets of paper and the function of arranging and stacking the sheets of paper on a stacker tray in the paper post-processing processes that discharge the paper from the paper discharge to the stacker tray.

In the conventional paper stacking device in the paper post-processing, disclosed is a roller structure movable in the vertical direction so as to move the paper to the stacker tray. This is a structure to enable the paper transferred after lowering the roller to move by pressing the paper toward the stacker tray.

In such a structure, there is a possibility that the paper is removed or pressed in the process of moving the paper by the rotation and the friction force of the roller. In addition, sheets of paper are sometimes not easily arranged in the process of moving the paper to the roller above the stacker tray, and the sheets of the paper are sometimes not arranged by the friction between the sheets of the paper in the process of the paper dropping on the stacker tray.

Thus, there is a problem that the operator must arrange the paper again after the paper is stacked on the stacker tray, and therefore the present applicant has proposed a paper post-processing device that makes it possible to grip several sheets of the arranged paper after stacking and arranging the paper temporarily on the paper stacking plate, and to transfer the paper to the stacker tray to stack so as not to fold and bend the paper (Patent Literature 1).

CITATION LIST

Patent Literature

Patent Literature 1: JP 2003-89464 A

SUMMARY OF INVENTION

Technical Problem

Thus, it has a structure to grip several sheets of the arranged paper after stacking and arranging the paper temporarily on the paper stacking plate, and to transfer the paper to the stacker tray, and the method of pulling out the paper by gripping the rear end portion of the sheets with a gripper and bringing both end portions of the paper not gripped into contact with the wall is employed, but this pulling is performed on a revolving locus of the gripper, whereby when the paper comes into contact with the wall surface on the way (when the paper is oblique rather than parallel to the wall), the collision force against the wall surface becomes stronger, and therefore the paper of the portion not gripped is easily bent (turned up), and there is a possibility that the paper is damaged.

The present invention is made in view of the above points, and has an object to provide a paper post-processing device capable of gripping several sheets of paper to transfer and of stacking the paper on the stacker tray without damaging the paper.

Solution to Problem

To solve the problems, the present invention is configured as follows.

In the invention (1), there is provided a paper post-processing device including: a base tray configured to stack paper transferred from an image forming device; a paper transferring unit including a paper grip means configured to grip a rear end of a paper bundle stacked on the base tray, and a paper transfer means configured to transfer the paper grip means; and a stacker tray configured to stack paper transferred from the paper transferring unit, wherein the paper grip means includes an ejector to be fixed and a gripper rotatably configured about a predetermined angle to the ejector, and is configured to grip the several sheets of paper by the ejector and the gripper, further including a grip release means configured to release a grip by the ejector and the gripper, and wherein the grip release means releases the grip by the ejector and the gripper by using a transfer of the paper grip means, and arranges and stacks the paper on the stacker tray.

In the invention (2), there is provided the paper post-processing device according to (1), wherein the grip release means includes a release guide member disposed in the device main body, transfers the gripper while causing the gripper to abut against the release guide member by the paper grip means, and releases the grip by the ejector and the gripper.

In the invention (3), there is provided the paper post-processing device according to (1), wherein the grip release means includes a release guide member disposed in the device main body, and wherein the paper grip means includes a release lever configured to release the grip of the gripper, and transfers the release lever while causing the release lever to abut against the release guide member by the paper grip means, and releases the grip by the ejector and the gripper by using the release lever.

In the invention (4), there is provided a paper post-processing device including: a base tray configured to stack paper transferred from an image-forming device; a paper transferring unit including a paper grip transfer means configured to grip and transfer a rear end of a paper bundle stacked on the base tray, and to release a grip in a discharge position to stack on the stacker tray, and a paper guide transfer means configured to hold and transfer a rear end portion of several sheets of paper housed in the paper stacking plate; a stacker tray configured to stack paper transferred from the paper transferring unit; and a drive means configured to link the paper grip transfer means and the paper guide transfer means to drive by a single drive source, wherein the paper guide transfer means sets a position where the several sheets of paper housed on the paper stacking plate are aligned as an initial position to hold the paper, holds and transfers the rear end portion of the several sheets of paper to a grip position for gripping paper by the paper grip transfer means, and returns to the initial position at a timing of gripping and transferring the paper by the paper grip transfer means, or subsequently.

In the invention (5), there is provided the paper post-processing device according to (4), wherein the paper guide transfer means is disposed on each side of the paper grip transfer means.

In the invention (6), there is provided the paper post-processing device according to (4), including a pair of paper grip transfer means, wherein the paper guide transfer means is disposed between the pair of paper grip transfer means.

In the invention (7), there is provided the paper post-processing device according to (4), wherein the paper guide transfer means includes an end fence configured to hold a rear end portion of paper, and wherein the drive means transfers the end fence by linking with the paper grip transfer means in the initial position, releases the linkage at a timing of gripping and transferring the paper by the paper grip transfer means, or subsequently, and returns the end fence to the initial position.

ADVANTAGEOUS EFFECTS Of INVENTION

Due to the above configuration, the present invention has the following effects.

In the invention (1), the configuration releases the grip by the ejector and the gripper by using a transfer of the paper grip means, and arranges and stacks the paper on the stacker tray, and therefore the sheets of the paper are not bent (turned up) even when the paper is in contact with the wall surface, and can stack on the stacker tray without being damaged.

In the invention (2), the configuration is a simple configuration that can transfer the gripper while causing the gripper to abut against the release guide member by the paper grip means, and release the grip by the ejector and the gripper, and that includes only the release guide member.

In the invention (3), the configuration is a simple configuration that can transfer the release lever while causing the release lever to abut against the release guide member by the paper grip means, and release the grip by the ejector and the gripper by using the release lever, and that includes only the release guide member and the release lever.

In the invention (4), the configuration links the paper grip transfer means and the paper guide transfer means to drive by a single drive source, whereby the configuration sets a position where the several sheets of paper housed on the paper stacking plate are aligned as an initial position to hold the paper, holds and transfers the rear end portion of the several sheets of paper to a grip position for gripping paper by the paper grip transfer means, and returns to the initial position at a timing of gripping and transferring the paper by the paper grip transfer means, or subsequently, whereby several sheets of paper can be accurately aligned and reliably gripped to be transferred in a simple and low-cost structure.

In the invention (5), the paper guide transfer means is disposed on each side of the paper grip transfer means, whereby the several sheets of paper can be accurately aligned and transferred to the grip position, and the paper can be accurately gripped and transferred to be stacked on the stacker tray without being damaged and without being shifted.

In the invention (6), the configuration includes a pair of paper grip transfer means, and the paper guide transfer means is disposed between the pair of paper grip transfer means, whereby the several sheets of paper can be accurately aligned and transferred to the grip position, and the paper can be accurately gripped on both sides of the paper and transferred to be stacked on the stacker tray without being damaged and without being shifted.

In the invention (7), the configuration transfers the end fence by linking with the paper grip transfer means in the initial position, releases the linkage at a timing of gripping and transferring the paper by the paper grip transfer means, or subsequently, and returns the end fence to the initial position, whereby the several sheets of paper can be accurately aligned, gripped, and transferred in a simple structure.

DESCRIPTION OF EMBODIMENTS

In the following, the embodiments of the paper post-processing device of the present invention will be described. The embodiments of the present invention are intended to indicate the most preferred form of the invention, and the present invention is not limited thereto.

(First Embodiment)

Figure 1:
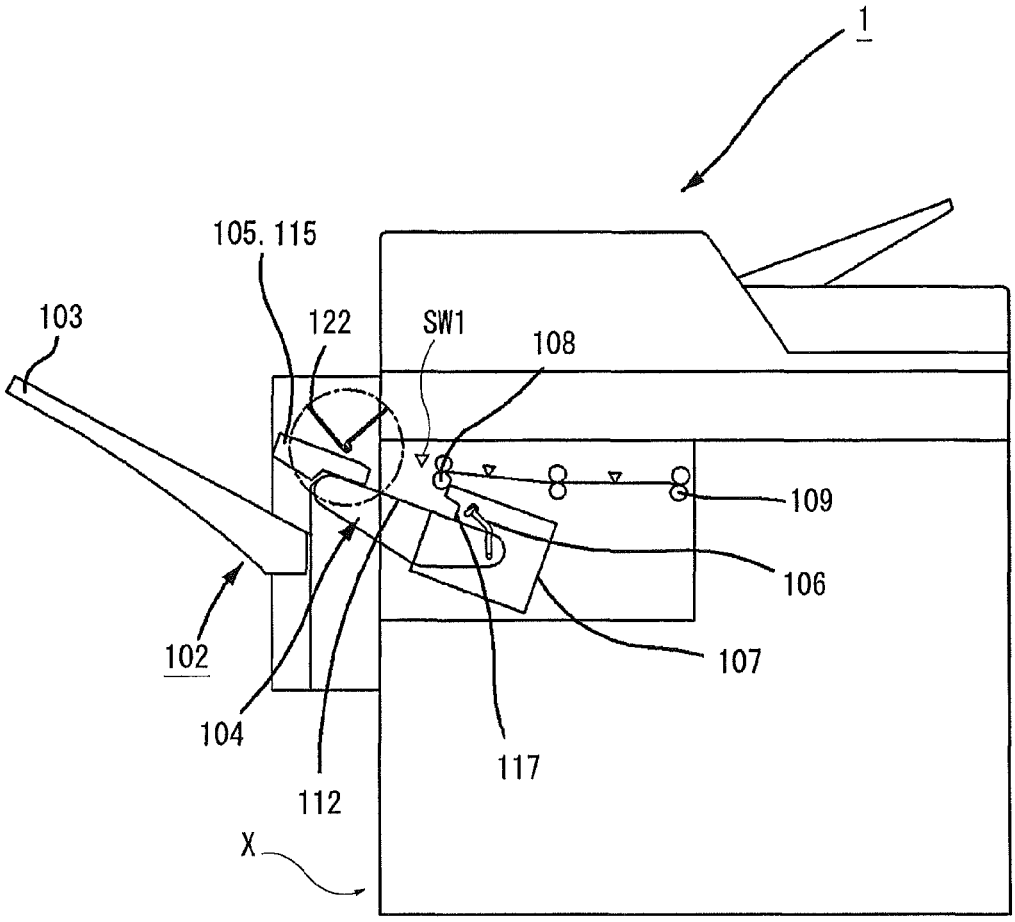
FIG. 1 is a diagram showing a state where the paper post-processing device is coupled to an image-forming device such as a copying machine.

The paper post-processing device of the present embodiment will be described with reference to FIGS. 1 to 3. A paper post-processing device 102 is disposed so as to be detachable in the image-forming device 1 such as a copying machine, a printer, and a multifunction machine, and the paper post-processing device 102 includes a paper transferring unit 104 and a stacker tray 103 configured in the lower portion of the paper transferring unit 104. The paper transferring unit 104 includes a pair of joggers 105 and 115, a base tray 112, an extension guide 113, a rear wall 117, and a gripper 106. In addition, in the lower side end portion of the paper transferring unit 104, an additional device such as a stapler 107 capable of post-processing the paper bundle Pb stacked on the paper transferring unit 104 is disposed.

A paddle 122 is disposed on the upper side of the base tray 112 of the paper transferring unit 104, and an inlet roller 109 and a discharge roller 108 constituting the paper transfer means configured to transfer the paper in the paper transferring unit 104 are disposed on the upper side of the paddle 122. When the paper Pa is transferred from the image-forming device 1, the transferred paper Pa is stacked in the paper transferring unit 104 through the inlet roller 109 and the discharge roller 108, then post-processed by the stapler 107, and the post-processed paper bundle Pb is discharged onto the stacker tray 103.

Figure 2:
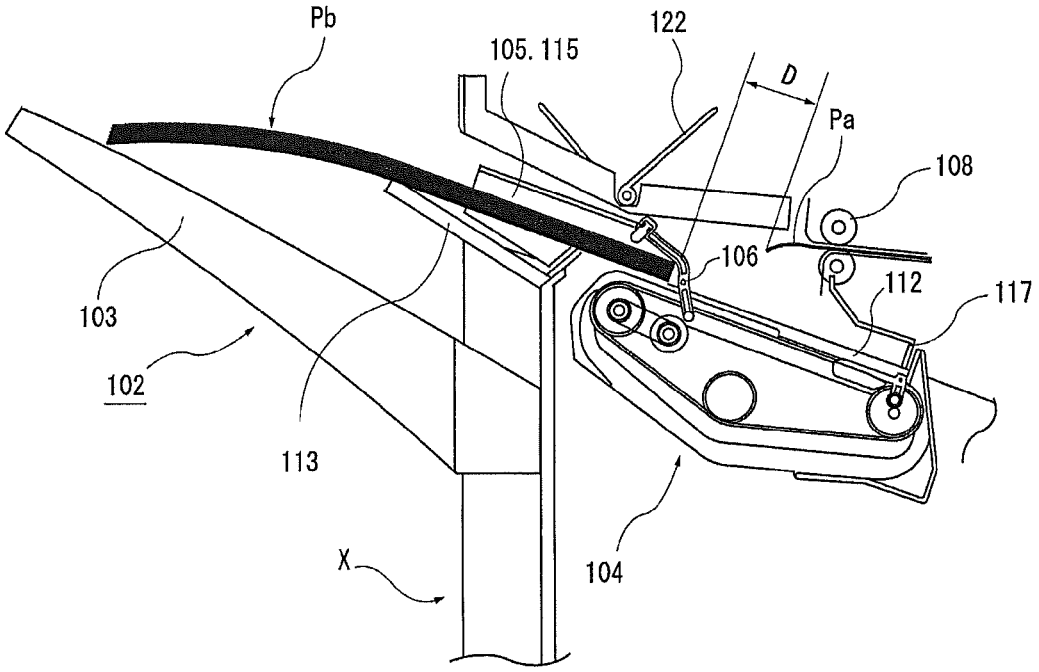
FIG. 2 is a cross-sectional view showing the transfer state of the paper of the paper post-processing device.
Figure 3:
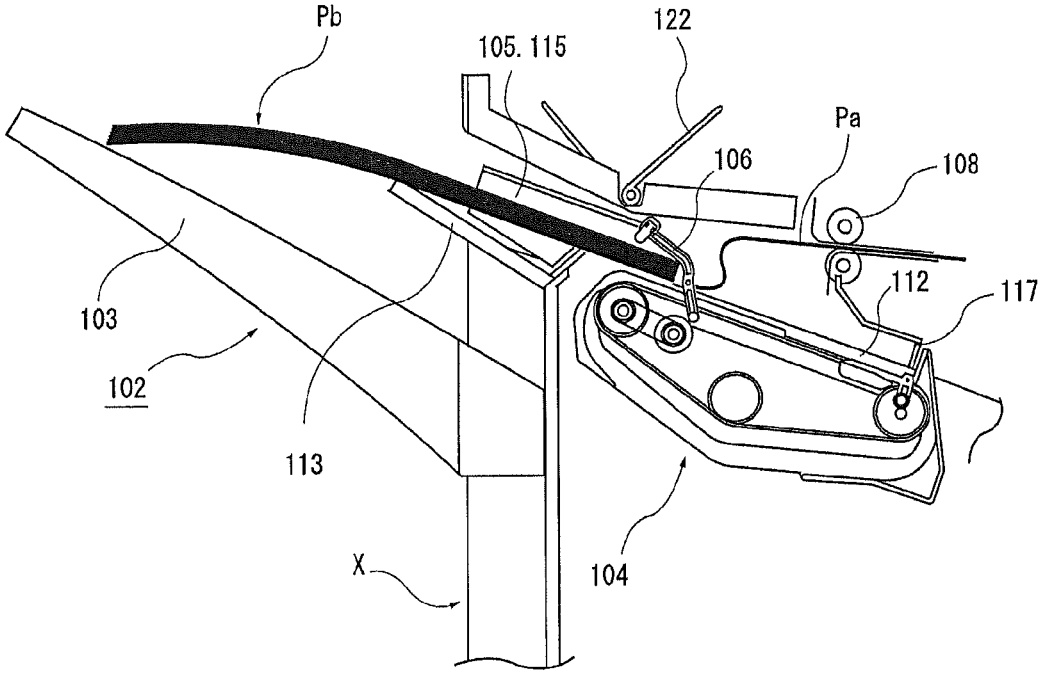
FIG. 3 is a cross-sectional view showing a state where interference of the paper of the paper post-processing device occurs.

Although the paper post-processing device 102 thus configured has a structural problem that the leading edge of the following paper Pa interferes with the post-stage of the gripper 106 discharging the paper bundle Pb while the paper bundle Pb is discharged by the gripper 106 as shown in FIG. 3, it is conceivable to use the method of delaying the following paper Pa to transfer so as to maintain the spacing D between the post-stage of the gripper 106 and the front end of the following paper Pa so that the front end of the following paper Pa does not overlap the gripper 106 as shown in FIG. 2, or the method of preventing the front end of the following paper Pa from preceding the gripper 106 by increasing the feed rate of the gripper 106, but there is a limit to transferring the following paper Pa at a high speed in the paper transferring unit 104 during the discharge of the paper bundle Pb, and the driving efficiency of the paper post-processing device 102 decreases.

The paper post-processing device 102 of the present embodiment will be described with reference to FIGS. 4 to 13. The paper post-processing device 102 of the present embodiment includes a paper transferring unit 104 and a stacker tray 103 configured in the lower portion of the paper transferring unit 104. The paper transferring unit 104 includes a base tray 112 configured to stack the paper Pa transferred from the image-forming device 1, a pair of joggers 105 configured to align the paper Pa to be stacked on the base tray 112, a gripper 106 disposed in the base tray 112 and configured in the rear of the rear wall 117 so as to extrude the paper Pa stacked on the base tray 112 on the outside, and an extension guide 113 configured so as to be protrudable by being extended in the front end of the base tray 112.

Meanwhile, a stapler 107 is disposed in the lower side end portion of the base tray 112. The stapler 107 is configured so as to be capable of selectively stapling the end portion of the paper bundle Pb to be stacked in the paper transferring unit 104. In addition, a paddle 122 is disposed on the upper side of the base tray 112 of the paper transferring unit 104, and an inlet roller 109 and a discharge roller 108 configured to transfer the paper in the paper transferring unit 104 are disposed on the upper side of the paddle 122.

The paper Pa is stacked on the base tray 112 through the inlet roller 109 and discharge roller 108. In the process of the paper Pa being stacked on the base tray 112, the paddle 122 molded from materials such as rubber and silicone is driven and lightly touches the upper surface of the paper, whereby the fraying and softening of the paper Pa can be prevented by the post-stage portion of the paper being guided so as to be pulled down with the rear wall 117. In particular, among a pair of joggers 105 and 115, one jogger 115 to be selected functions as the fixed jogger, and the other jogger 105 functions as the drive jogger, the end portions positioned toward the discharge roller 108 of the respective joggers are configured to have slopes 50 and 51, and the drive jogger 105 is configured so as to be capable of interval adjusting in the direction perpendicular to the direction where the paper Pa is transferred.

In the present embodiment, the structure of adjusting the interval between the joggers in a state where one jogger 115 is fixed and the other jogger 105 is driven will be described as an example. It is configured so that the paper stacked on the base tray 112 is shifted towards the fixed jogger 115 positioned a predetermined distance P away in the paper width direction perpendicular to the transfer direction of the paper by the drive jogger 105 being moved, to align.

Figure 4:
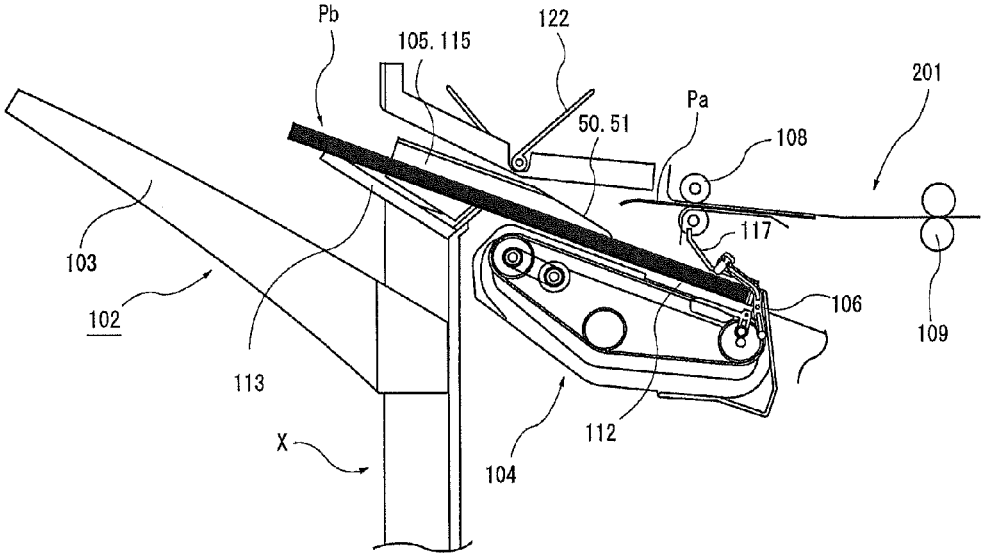
FIG. 4 is a cross-sectional view for illustrating an operation process of the paper post-processing device.
Figure 9:
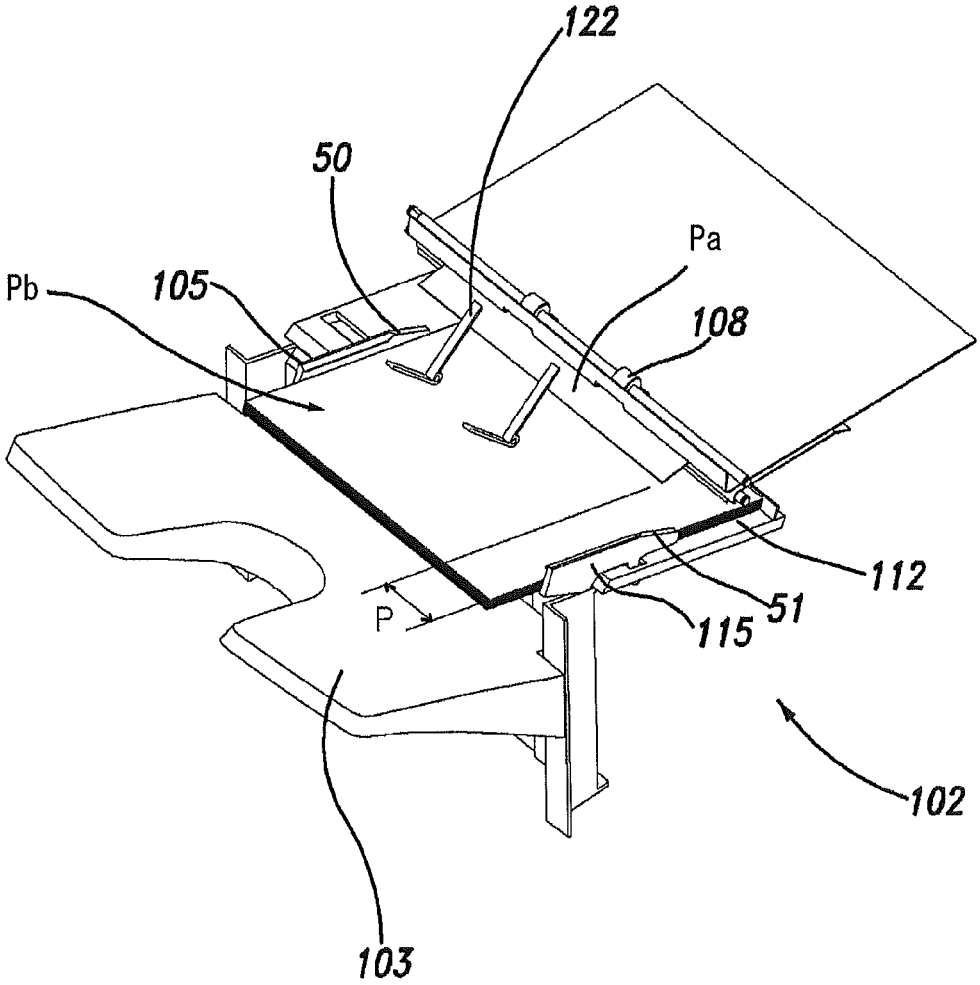
FIG. 9 is a perspective view for illustrating an operation process of the paper post-processing device.

In the paper post-processing device 102 of the present embodiment, as shown in FIGS. 4 and 9, the extension guide 113 is positioned to advance relative to the stacker tray 103, and when the paper Pa is transferred onto the base tray 112 from the image-forming device 1, while the drive jogger 105 on one side standing outside moves towards the fixed jogger 115 on the other side set as the reference, the drive jogger 105 aligns the paper to stack until the preset number of sheets are stacked by driving away (shifting) the side surface of the transferred paper Pa.

Although it is desirable that the drive jogger 105 align the paper Pa by pressing the side surface of the paper Pa and shifting the paper Pa towards the fixed jogger 115 each time the paper Pa is transferred one sheet at a time onto the base tray 112, it is not limited thereto, and the fixed jogger 115 may be shifted by pressing the side surface of the paper arranged to stack at a time in the middle of waiting until a predetermined set number of sheets are stacked.

The aligned paper bundle Pb is at a state of being shifted to a position at a predetermined distance P from the end portion of the transferred following paper Pa, and is stacked on the base tray 112. When the pre-set number of sheets are shifted in the position at a predetermined distance P and completely stacked on the base tray 112, one paper bundle Pb is configured, and becoming stapling by using the stapler 107 and the like configured on the side of the paper transferring unit 104 leads the paper post-processing operation to completion.

Figure 5:
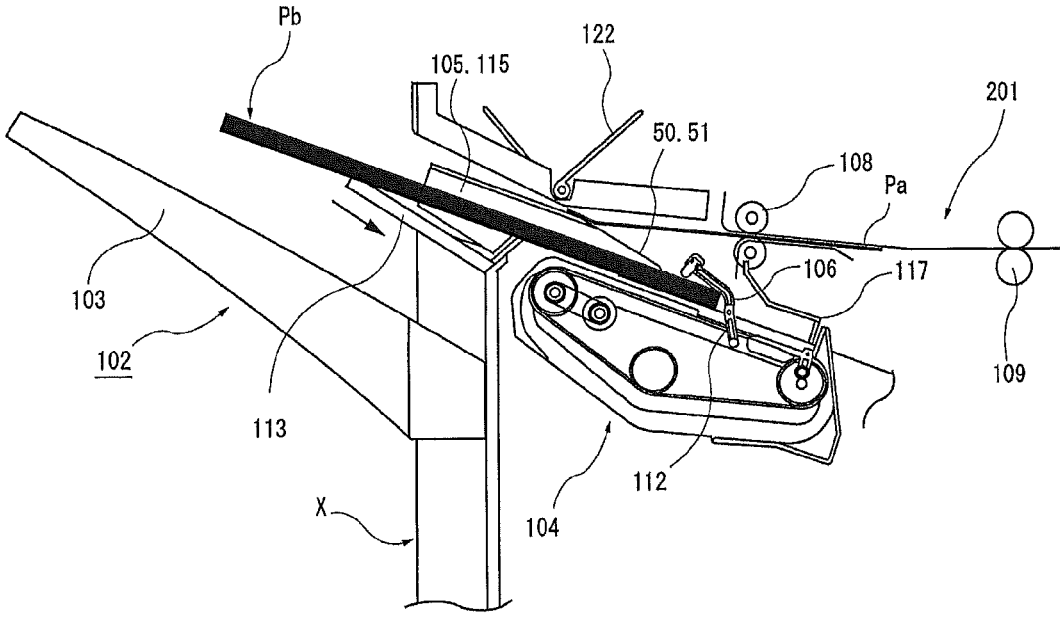
FIG. 5 is a cross-sectional view for illustrating an operation process of the paper post-processing device.
Figure 10:
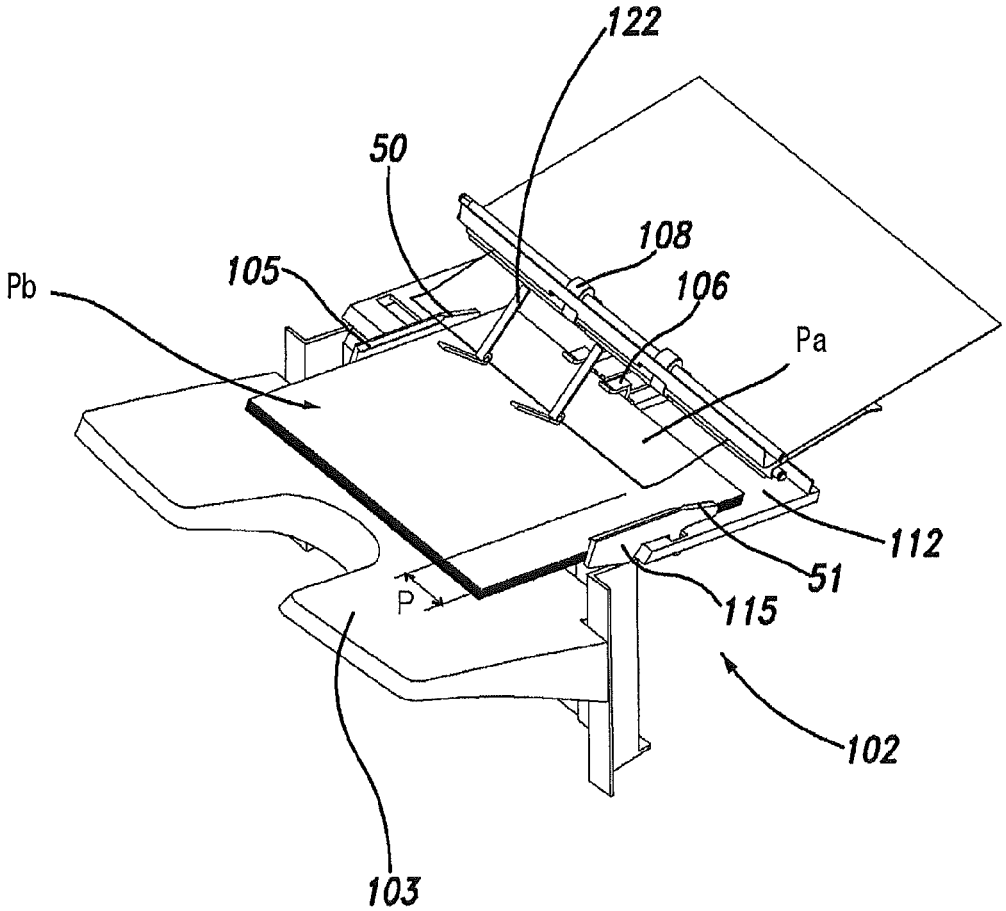
FIG. 10 is a perspective view for illustrating an operation process of the paper post-processing device.

After the post-processing operation of the paper bundle Pb is completed, as shown in FIGS. 5 and 10, the gripper 106 grips the rear end of the paper bundle Pb to start extruding. The extension guide 113 is retracted at the same time as the paper bundle Pb starts being discharged onto the stacker tray 103 by the gripper 106.

In the present embodiment, when the following paper Pa of the next lot of the paper bundle Pb is transferred in succession to one lot of the paper bundle Pb, the gripper 106 is driven so that the front end of the following paper Pa can be transferred to the region of the base tray 112 lower than the gripper 106 the post-stage of which extrudes the paper bundle Pb by preceding the position of the gripper 106. At this time, the front end of the following paper Pa precedes the gripper 106, and the gripper 106 is moved in a state where the drive jogger 105 is made to guide the paper bundle Pb to be discharged by positioning the drive jogger 105 inside the progress area of the following paper Pa (a state where the drive jogger is shifted toward the fixed jogger) so as to prevent the discharge wrinkle of the paper bundle Pb and to separate the preceding paper bundle Pb and the following paper Pa in the process of the post-stage being transferred to the area of the base tray 112 lower than the gripper 106.

Thus, in the state where the drive jogger 105 is positioned inside the transfer progress area of the following paper Pa, the next lot of the following paper Pa rides on the slope 50 of the drive jogger 105 to move up and to transfer, and the front end of the following paper precedes the gripper 106 to move, whereby the following paper Pa is separated from the paper bundle Pb and the following paper Pa can be transferred at a high speed in the area of the base tray 112 so as to be stable without the worryof jamming occurrence at the same time as only the paper bundle Pb can be discharged.

Figure 6:
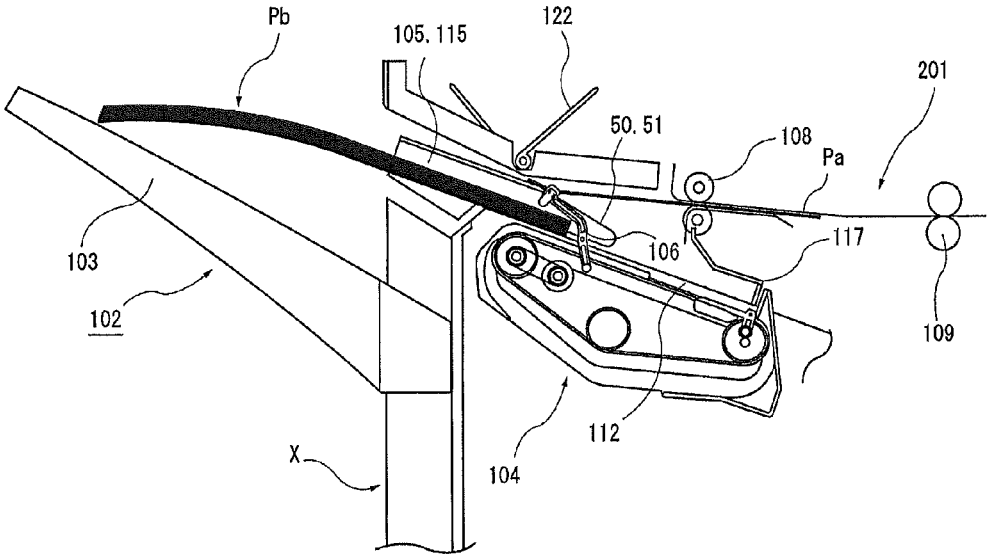
FIG. 6 is a cross-sectional view for illustrating an operation process of the paper post-processing device.
Figure 11:
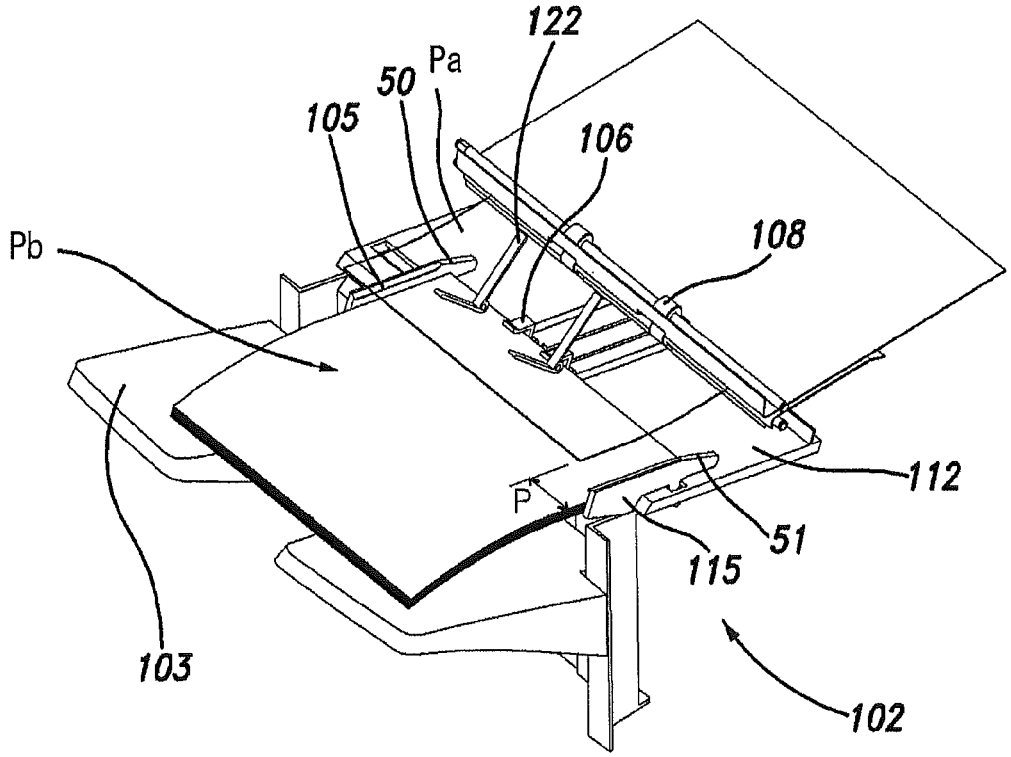
FIG. 11 is a perspective view for illustrating an operation process of the paper post-processing device.

FIGS. 6 and 11 represent the state just before the paper bundle Pb is discharged onto the stacker tray 103. After the paper bundle Pb is discharged and stacked on the stacker tray 103, the gripper 106 passes through on one side of the base tray 112 and moves toward the rear wall 117. The extension guide 113 retreats, and the paper bundle Pb is smoothly discharged onto the stacker tray 103 by the gripper 106.

Figure 7:
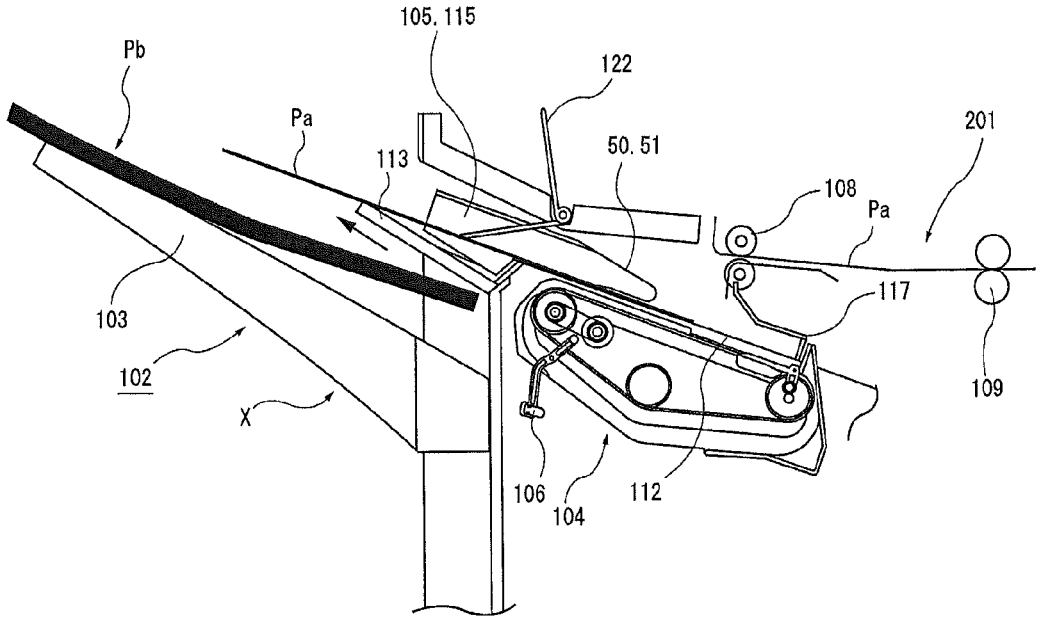
FIG. 7 is a cross-sectional view for illustrating an operation process of the paper post-processing device.
Figure 12:
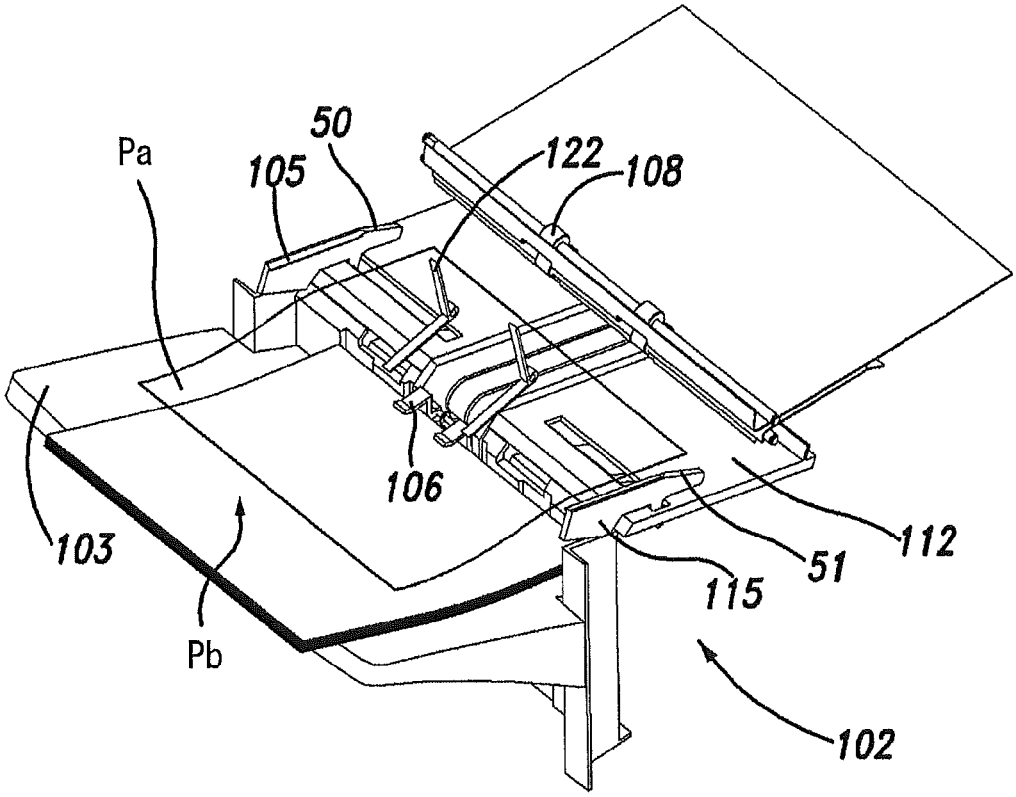
FIG. 12 is a perspective view for illustrating an operation process of the paper post-processing device.

In addition, as shown in FIGS. 7 and 12, the drive jogger 105 is moved outside the transfer area of the following paper Pa at the same time as the extension guide 113 moves forward at the moment the paper bundle Pb is extruded and stacked on the stacker tray 103, and the paddle 122 is driven so that the following paper Pa having completely slipped through the discharge roller 108 is not transferred to the front.

Figure 8:
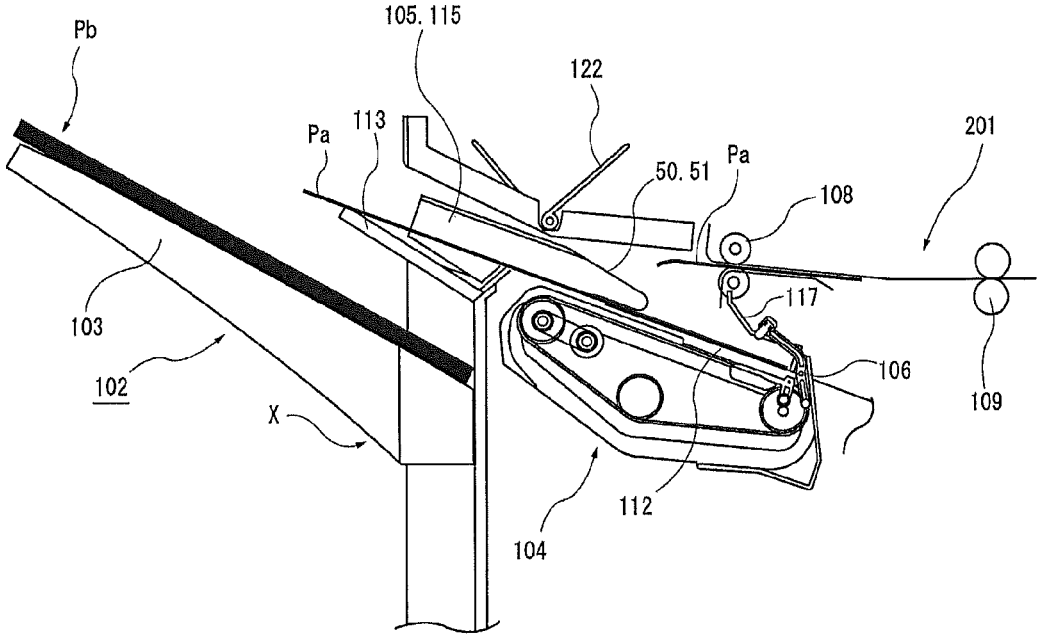
FIG. 8 is a cross-sectional view for illustrating an operation process of the paper post-processing device.
Figure 13:
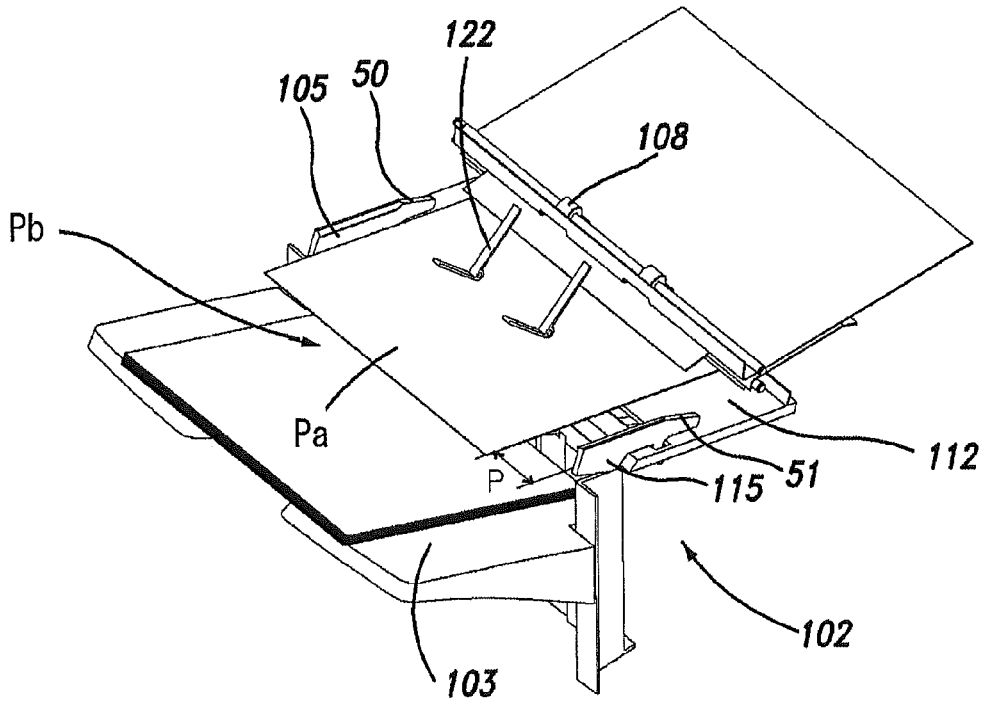
FIG. 13 is a perspective view for illustrating an operation process of the paper post-processing device.
Figure 14:
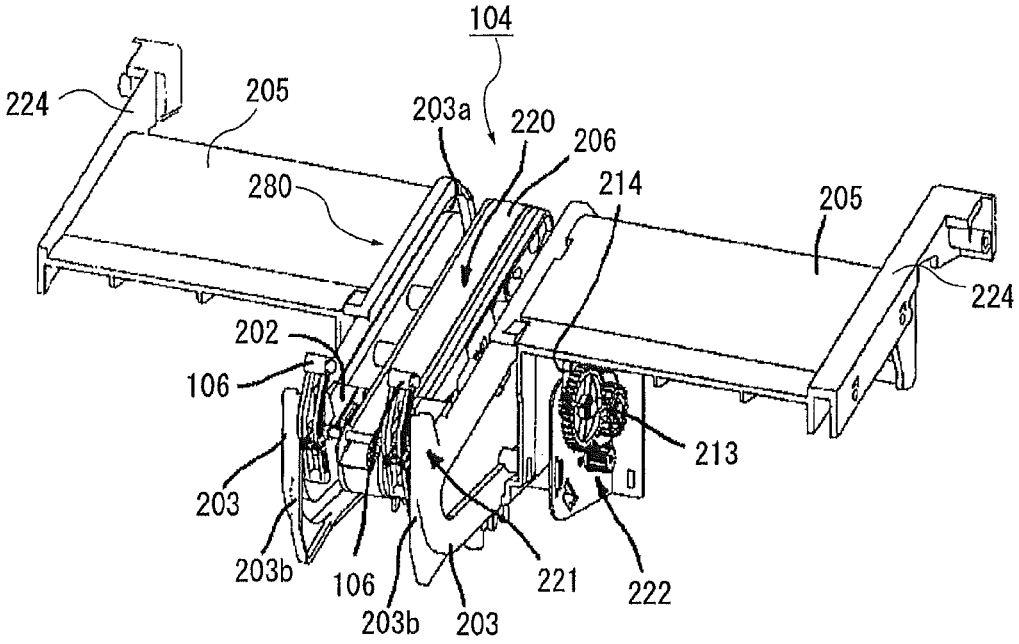
FIG. 14 is a perspective view showing the configuration of the paper transferring unit.
Figure 15:
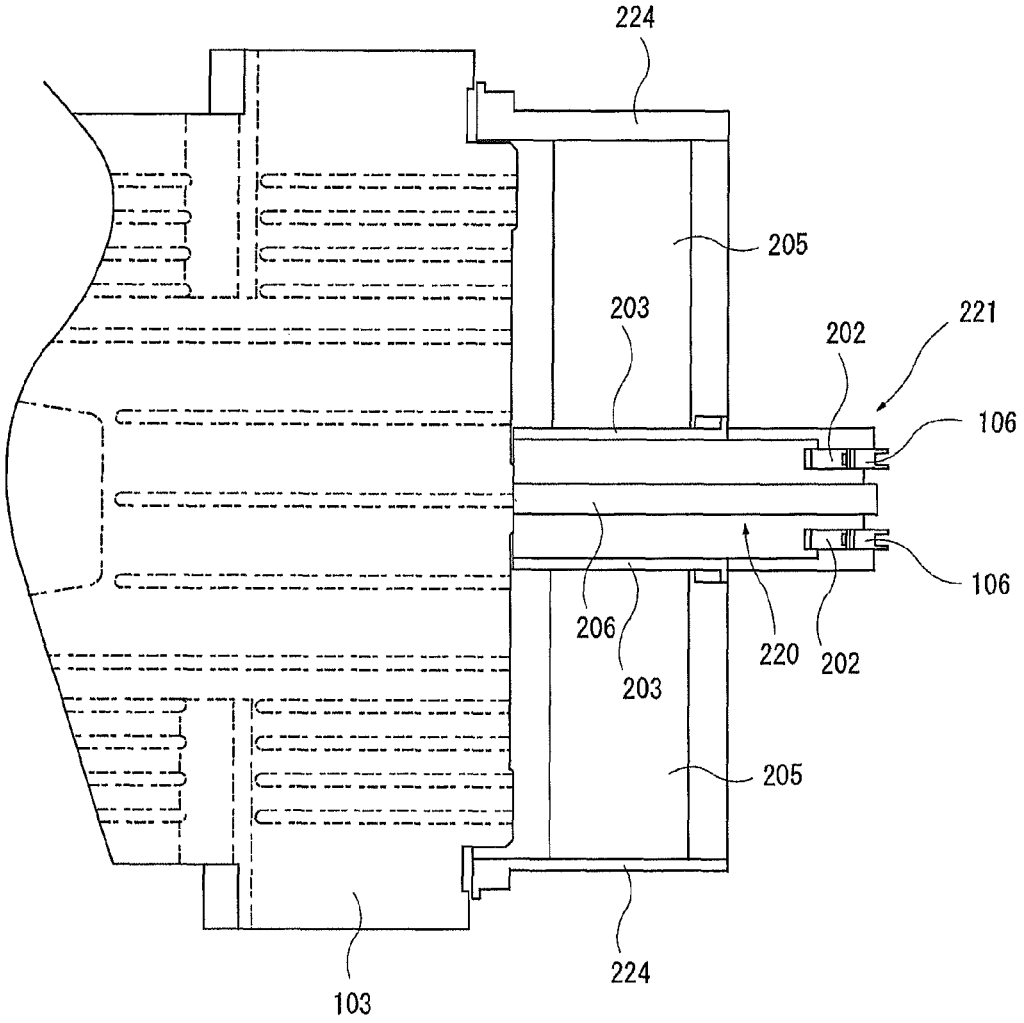
FIG. 15 is a plan view of the paper stacking in the paper transferring unit.
Figure 16:
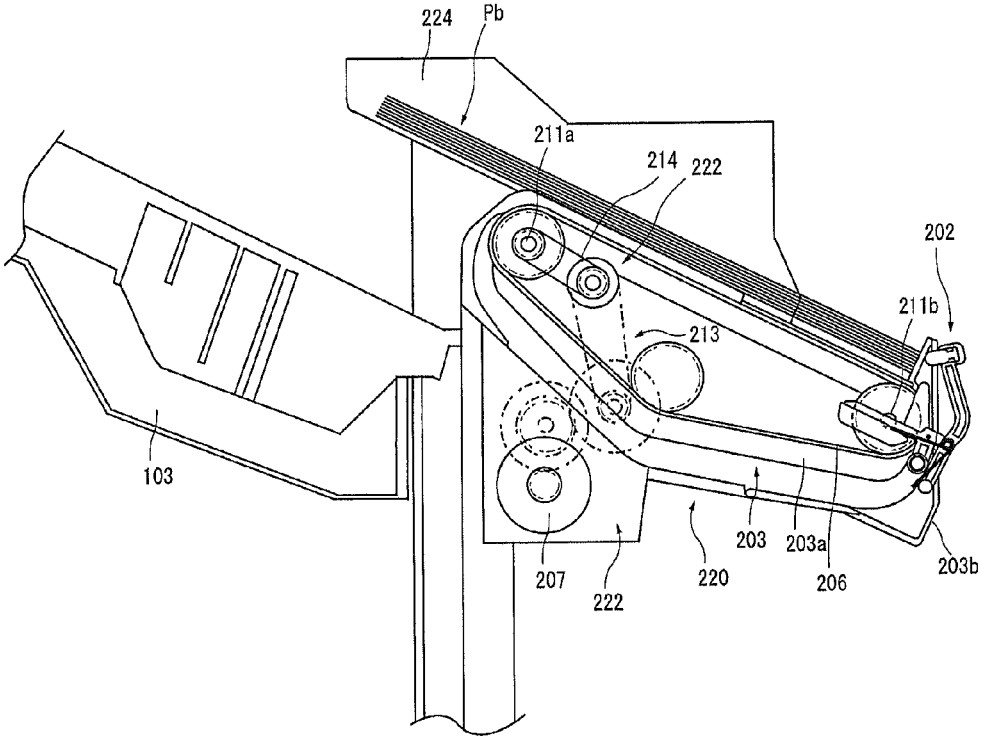
FIG. 16 is a cross-sectional view showing a state before the gripper of the paper transferring unit grips the paper.
Figure 17:
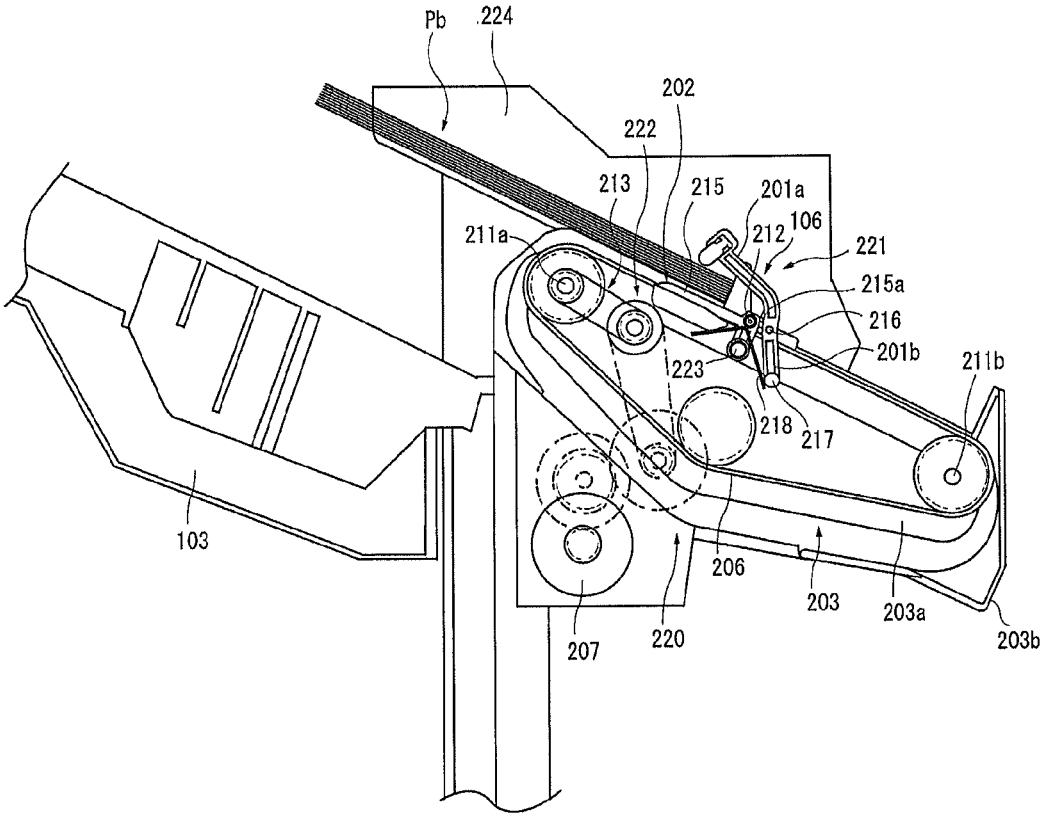
FIG. 17 is a cross-sectional view showing a state where the gripper of the paper transferring unit extrudes the paper with the stacker tray after gripping the paper.
Figure 18:
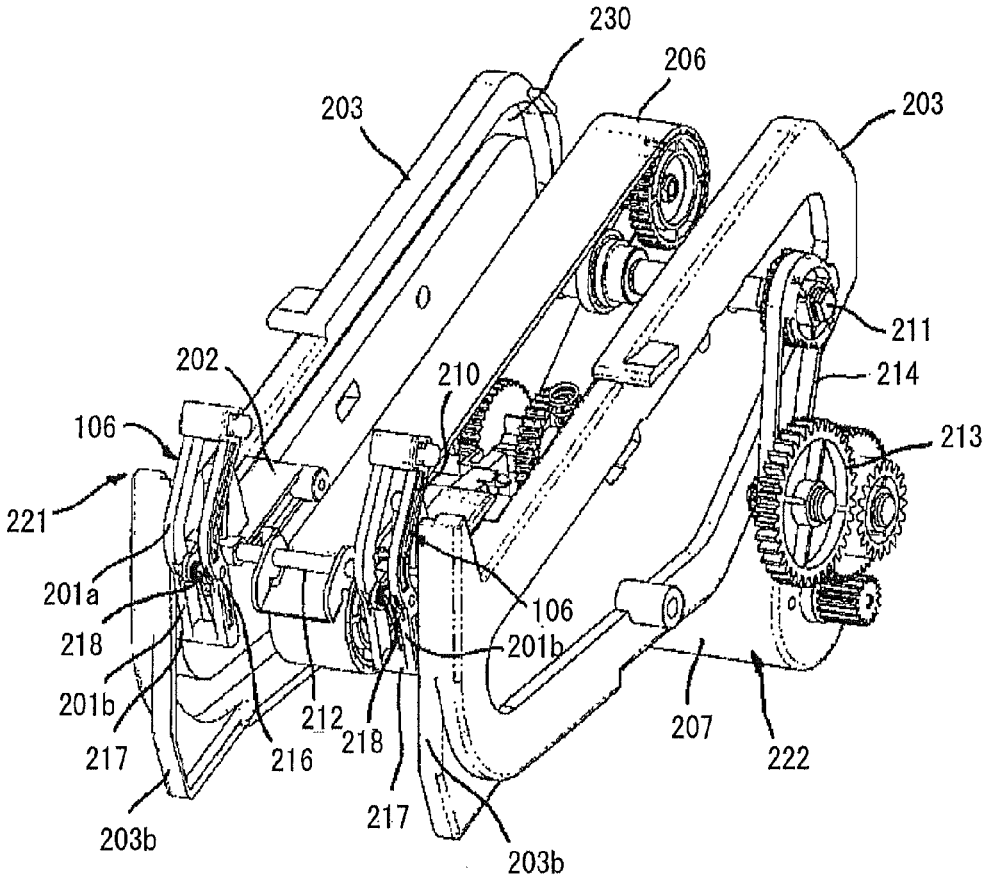
FIG. 18 is a perspective view showing a partial configuration of the paper stacking in the paper transferring unit.
Figure 19:
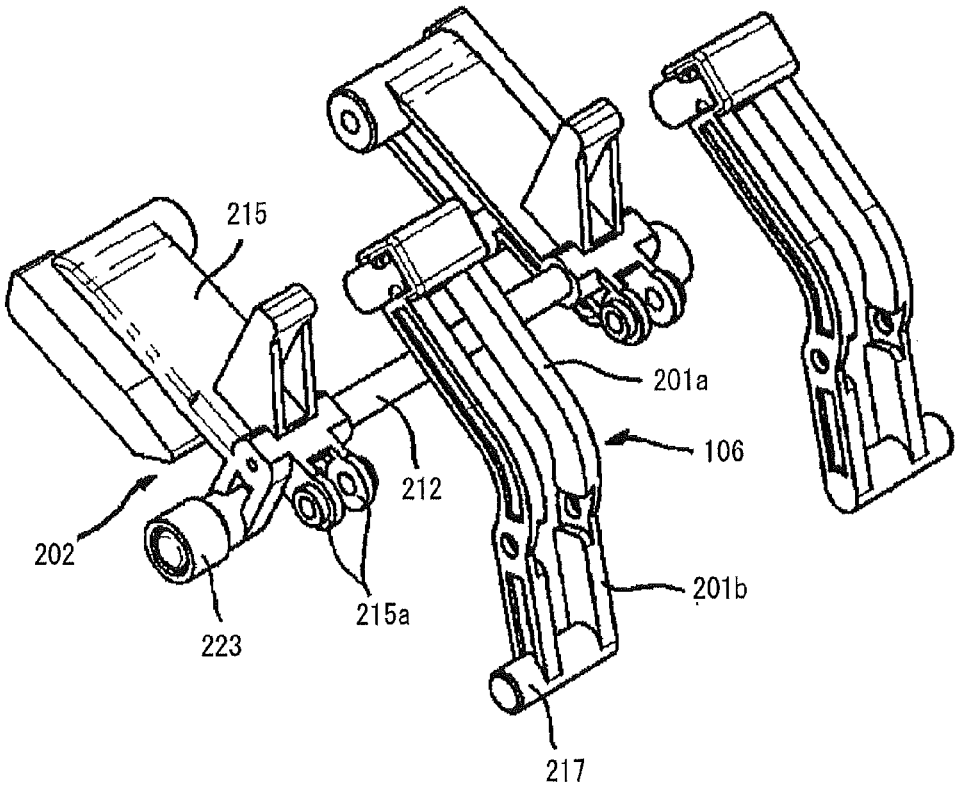
FIG. 19 is a principal part explanatory diagram of the fixed shaft where the ejector of the paper transferring unit is fixed.

The following paper Pa is supported by the extension guide 113, the paddle 122 and the inclination angle of the base tray 112, as shown in FIGS. 8 and 13, the rear end of the following paper Pa is aligned with the rear wall 117, and the side of the paper Pa is driven toward the fixed jogger 115 to the position at the predetermined distance P from the fixed jogger 115 by the drive jogger 105 being driven, and is aligned on the base tray 112 before the next following paper Pa reaches the slope 50 of the drive jogger 105.

Meanwhile, when the following paper Pa is not transferred, after the paper post-processing process, the paper bundle Pb is discharged onto the stacker tray 103, and the stacking and the operation are finished.

Next, the configuration of the paper transferring unit 104 will be described with reference to FIGS. 14 to 27. The paper transferring unit 104 of the present embodiment has the structure that enables the paper to stack in an orderly unchanged condition on the stacker tray 103 configured to house the paper to stack while moving vertically.

In the central portion of the base tray 112, the paper transfer means 220 configured to grip several sheets of the paper bundle Pb housed in the base tray 112 to transfer to the stacker tray 103 is disposed. The paper transfer means 220 includes a guide means 280 configured so as to be capable of circulating along the paper moving direction, a paper grip means 221 configured to operate so as to grip the paper bundle Pb housed in the base tray 112 in a predetermined position while moving along the guide means 280, and a drive means 222 configured to drive the paper grip means 221 so as to circulate along the guide means 280.

The guide means 280 includes a pair of guide side plates 203, the pair of these guide side plates 203 are arranged in parallel in the direction where the paper bundle Pb is transferred in the central portion of the base tray 112, and each of the guide side plates 203 includes a rail groove **203*a* and a curved-surface cam 203*b*** forming a circulating orbit.

The circulating orbit of the rail groove **203*a* is configured so as to be parallel to the surface of the base tray 112. In addition, the curved-surface cam 203*b* is configured so as to approach the rail groove 203*a* on one side of the guide side plates 203 where the circulating orbit of the rail groove 203*a*** forms an ellipse.

Meanwhile, the paper grip means 221 fitted and driven by the guide side plates 203 is similarly configured, and the paper grip means 221 includes a fixed shaft 212 having both end portions fitted by the rail groove 203*a*, the fixed shaft configured to move along the rail groove 203*a*, an ejector 202 coupled to each side of the fixed shaft 212, and a gripper 106 rotatably configured about a predetermined angle to the ejector 202. At the end portion of the fixed shaft 212 fitted to the rail groove 203*a*, bearings, a roller 223, and the like can be disposed so as to smooth the movement of the fixed shaft 212.

The ejector 202 fixed to the fixed shaft 212 includes an ejector plate 215 and a support stand 215*a* projecting at a predetermined angle to the ejector plate 215, and the central portion of the gripper 106 is fixed to the end portion of the support stand 215*a* by a hinge portion 216.

The gripper 106 fixed to the end portion of the support stand 215*a* is divided into a first extended portion 201*a* and a second extended portion 201*b* around the hinge portion, and a boss 217 projects in the second extended portion 201*b* and is configured so as to be connected to the curved-surface cam 203*b* of the guide side plate 203. Meanwhile, a spring 218 acting so as to press the first extended portion 201*a* of the gripper 106 against the ejector plate 215 of the ejector 202 is configured to fit the hinge portion 216.

In the paper grip means 221, in the process of the ejector 202 attached to the fixed shaft 212 moving along the rail groove 203*a* of the guide side plate 203, when the ejector 202 reaches the position of the curved-surface cam 203*b* of the guide side plate 203, the boss 217 of the gripper 106 coupled with the ejector 202 is connected to the curved-surface cam 203*b*, and the second extended portion 201*b* of the gripper 106 connected to the boss 217 is pressed to be rotated. Therefore, the first extended portion 201*a* of the gripper 106 and the ejector plate 215 connected to each other by the elastic force of the spring 218 are spaced apart from each other, and it is at a ready state where the paper can be gripped.

The first extended portion 201*a* and the ejector 202 are spaced apart from each other, whereby in the ready state where the paper can be gripped, when the ejector 202 further moves along the rail groove 203*a* and is released from the area of the curved-surface cam 203*b*, the first extended portion 201*a* of the gripper 106, the ejector 202, and the ejector plate 215 of the ejector 202 are brought into contact again by the restoring force of the spring 218. That is, the rear end of the paper bundle Pb fitted between the first extended portion 201*a* of the gripper 106 and the ejector plate 215 of the ejector 202 can be gripped.

Meanwhile, the drive means 222 configured to circulate the paper grip means 221 along the rail groove 203*a* of the guide side plate 203 includes a transfer belt 206 configured to fit between the grip-side rotating shaft 211*b* and the stacker tray-side rotating shaft 211*a*, and a drive motor 207 configured to drive the grip-side rotating shaft 211*b* and the stacker tray-side rotating shaft 211*a*. The paper grip means 221 is disposed on the transfer belt 206 being an endless transfer means, and a power transmission means 213 such as a pulley gear and a timing belt is interposed between the drive motor 207 and the stacker tray-side rotating shaft 211*a* and transmits the rotating force of the drive motor 207.

The transfer belt 206 is coupled with the fixed shaft 212 of the paper grip means 221, and moves together with the paper grip means 221 by the rotation of the transfer belt 206. Of course, the end portion of the fixed shaft 212 fits the rail groove 203*a*, and therefore the paper grip means 221 moves along the rail groove 203*a*.

The paper grip means 221 is configured so as to grip the rear end of the paper bundle Pb housed in the base tray 112 in the position corresponding to the grip-side rotating shaft 211*b*, and to stack the gripped paper Pa on the stacker tray 103 in the position corresponding to the stacker tray-side rotating shaft 211*a*.

Therefore, the circulating orbit of the transfer belt 206 and the circulating orbit of the rail groove 203*a* have to be configured so as to roughly match. The operation process of the paper transferring unit 104 will be described in detail.

Figure 20:
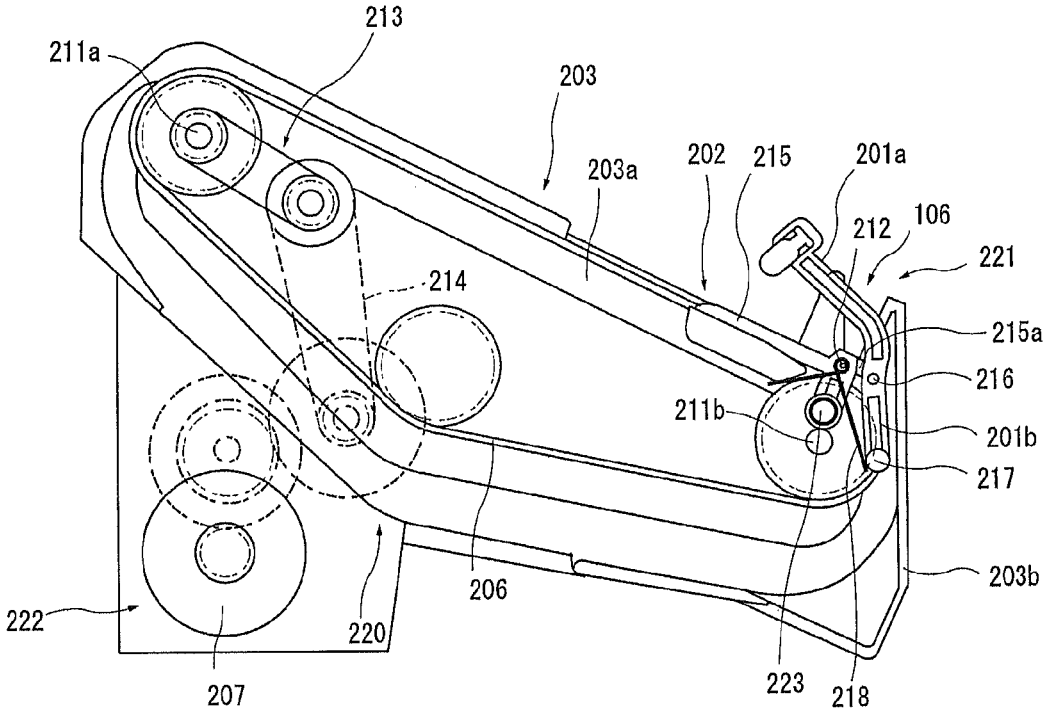
FIG. 20 is a connecting structure explanatory diagram between the ejector and the gripper of the paper transferring unit.
Figure 21:
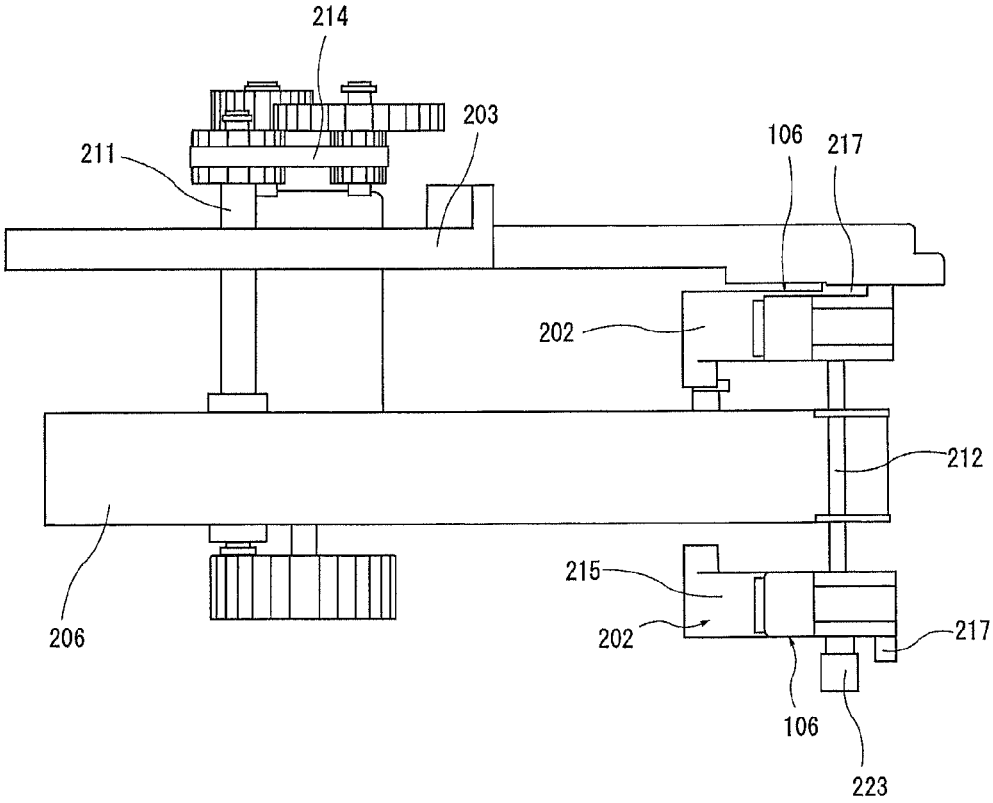
FIG. 21 is a plane structural diagram shown in FIG. 18.
Figure 22:
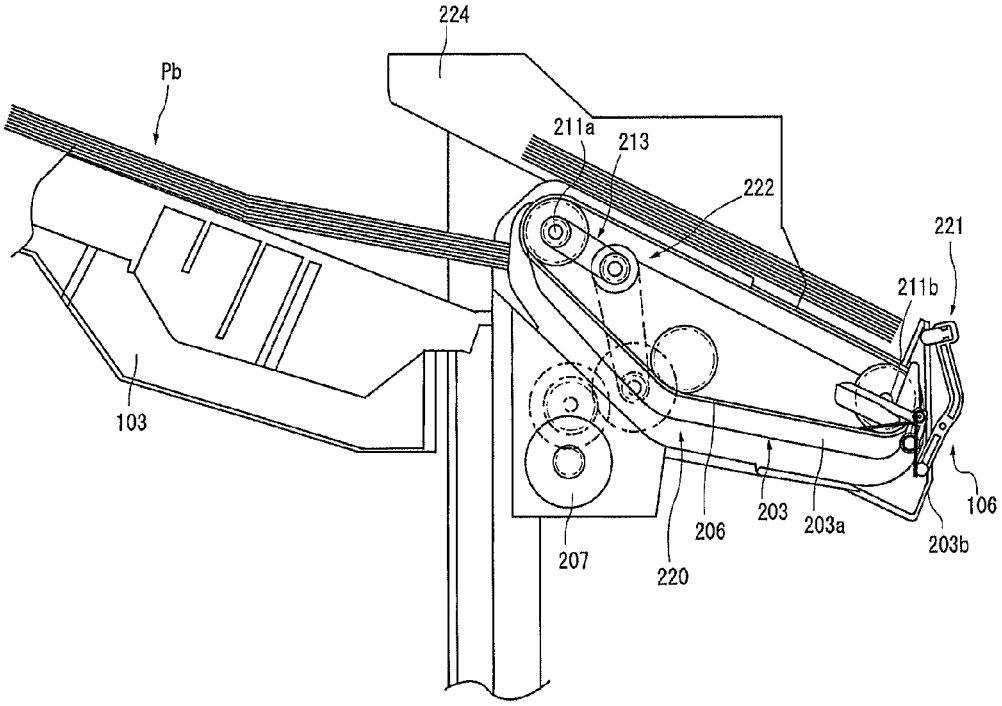
FIG. 22 is a process explanatory diagram for stacking the paper on the stacker tray of the paper transferring unit.
Figure 23:
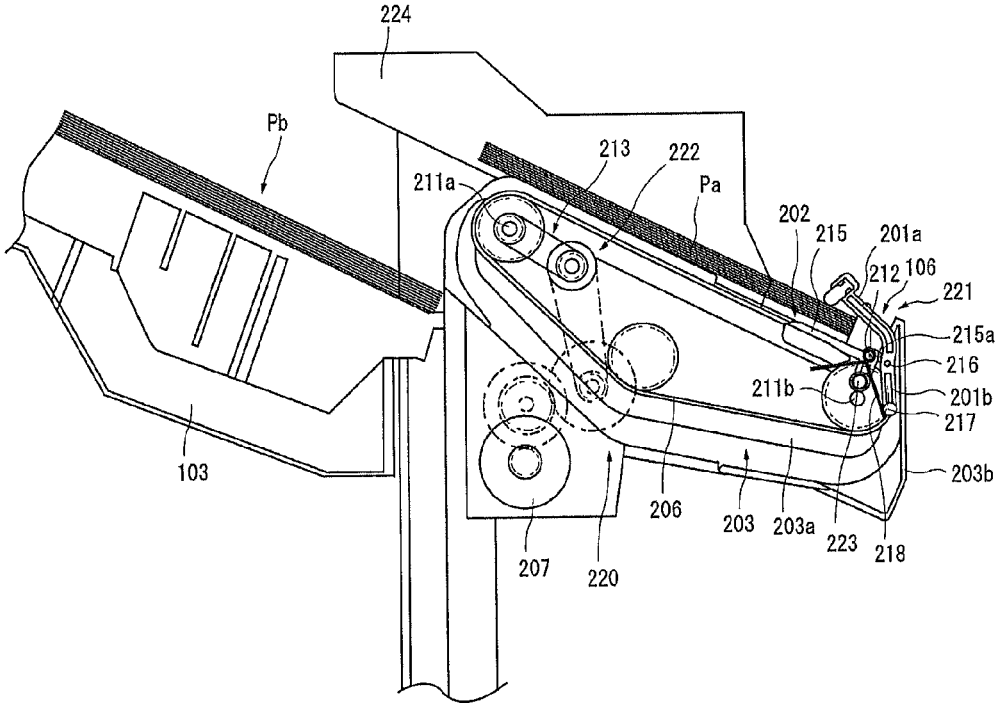
FIG. 23 is a process explanatory diagram of gripping the paper of the paper transferring unit.
Figure 24:
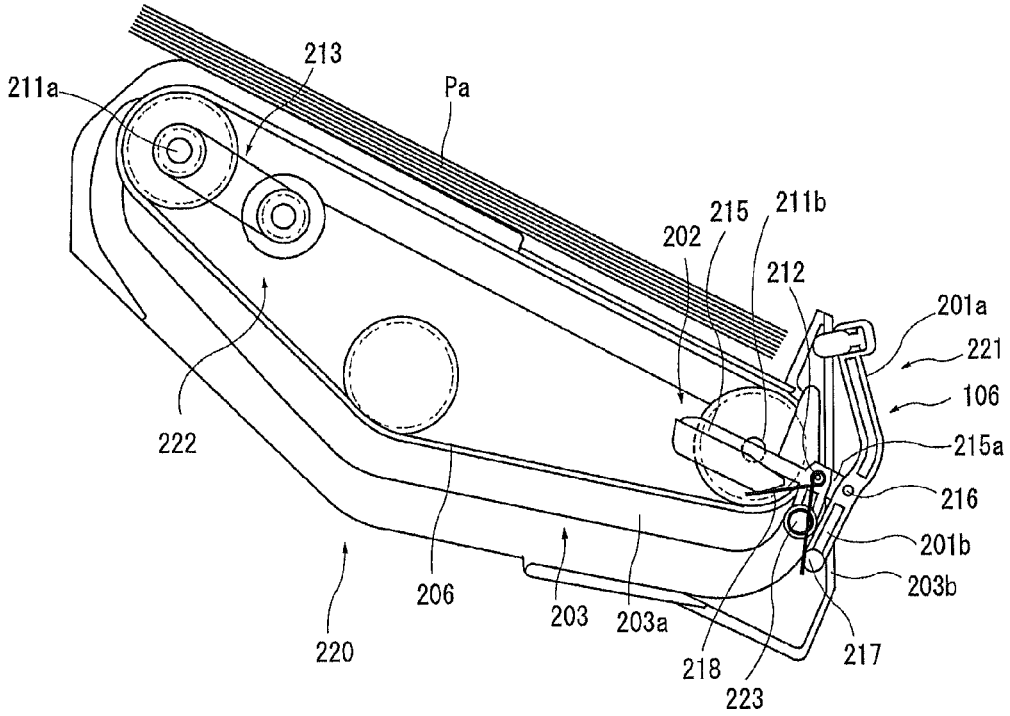
FIG. 24 is an operation process explanatory diagram of the paper transferring unit.

As shown in FIGS. 20 and 24, in the initial stage, the boss 217 is positioned in the base point of the curved-surface cam 203*b* of the guide side plate 203, and the boss 217 is pushed toward the inside while moving along the curved-surface cam 203*b*, and therefore the ejector plate 215 and the first extended portion 201*a* of the gripper 106 connected by the spring 218 are spaced apart, and it comes into a state where the rear end of the paper bundle Pb can be gripped.

The copying begins in this state, and when a predetermined number of sheets of the paper bundle Pb is housed in the base tray 112, the drive motor 207 is made to rotate by detecting the signal, the rotating power of the drive motor 207 is transmitted to the grip-side rotating shaft 211*b* and the stacker tray-side rotating shaft 211*a*, and the transfer belt 206 mounted on the grip-side rotating shaft 211*b* and the stacker tray-side rotating shaft 211*a* is rotated and moved.

Figure 25:
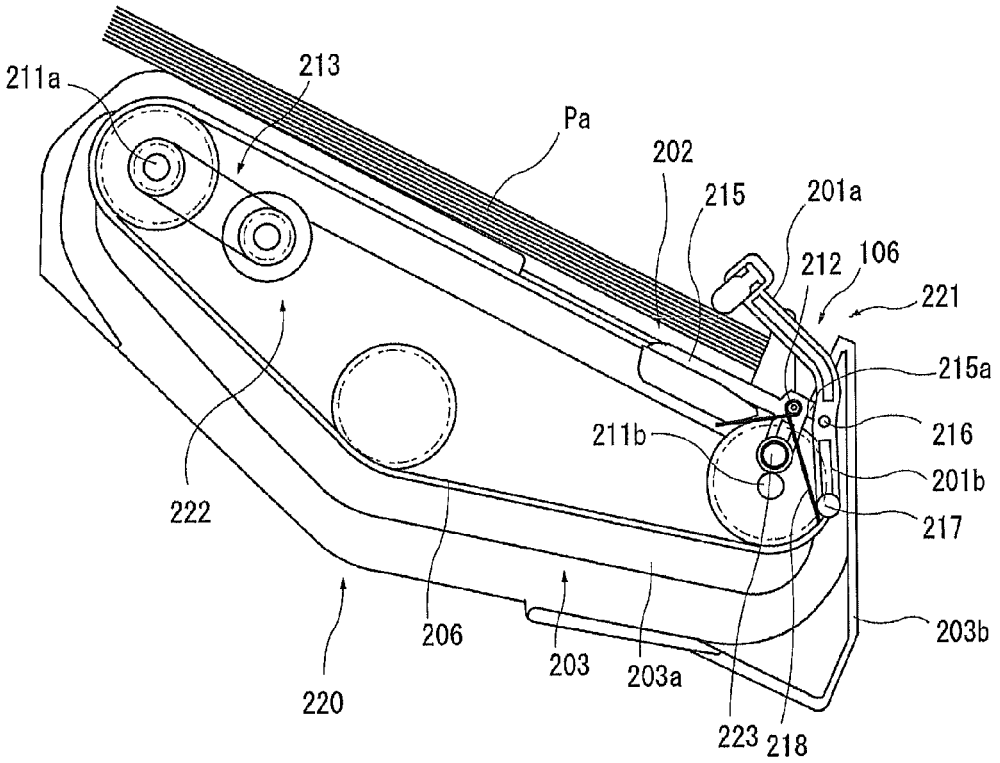
FIG. 25 is an operation process explanatory diagram of the paper transferring unit.
Figure 26:
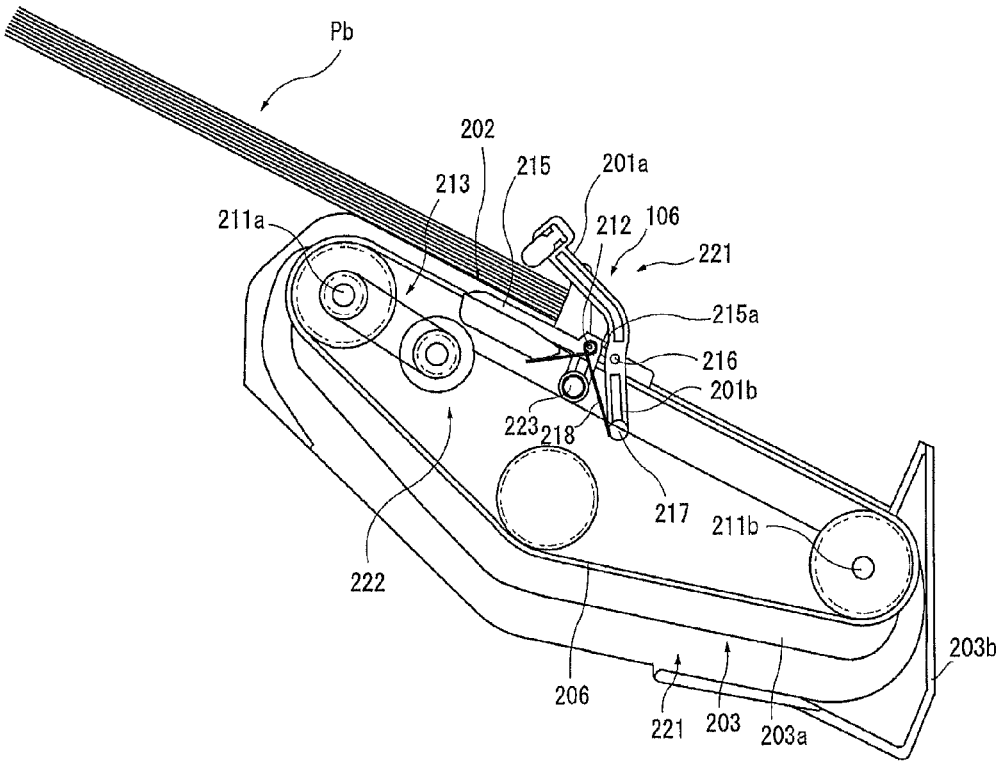
FIG. 26 is an operation process explanatory diagram of the paper transferring unit.

By the movement of the transfer belt 206, the ejector 202 fitted and fixed in the fixed shaft 212 moves about a predetermined interval along the rail groove 203*a*. At this time, as shown in FIG. 25, when the ejector 202 of the paper grip means 221 moves and the boss 217 of the gripper 106 is released from the area of the curved-surface cam 203*b*, the gripper 106 coupled with the ejector 202 by the hinge portion 216 returns to its original position by the restoring force of the spring 218. When returned to its original position, the gripper 106 grips the rear end of the stacked paper bundle Pb, and in a state of gripping the rear end of the paper bundle Pb as shown in FIG. 26, the ejector 202 moves along the rail groove 203*a*.

Figure 27:
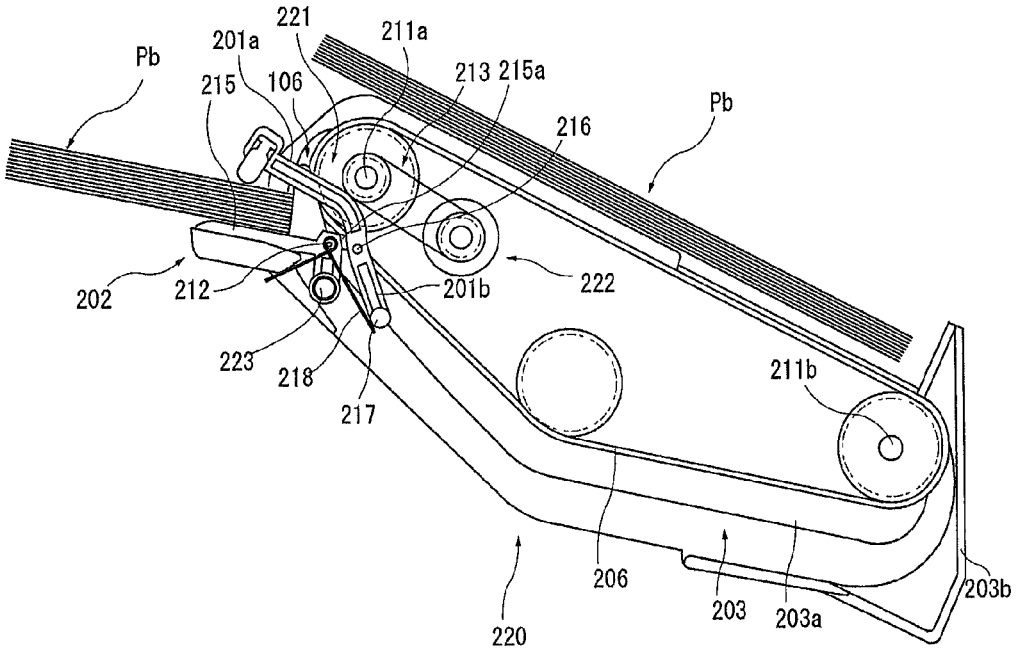
FIG. 27 is an operation process explanatory diagram of the paper transferring unit.

When the ejector 202 continues to move and reaches the position of the stacker tray 103 in a state where the paper grip means 221 grips the rear end of the paper bundle Pb as shown in FIG. 27, the majority of the surface of the paper bundle Pb is connected to the surface of the stacker tray 103. The ejector 202 rotates continuously and moves downward in a state where the paper bundle Pb is connected to the surface of the stacker tray 103, and therefore the first extended portion 201*a* of the gripper 106 gripping the rear end portion of the paper bundle Pb moves in an unchanged condition, the gripped paper bundle Pb is separated from the first extended portion 201*a*, and the gripped paper bundle Pb is lowered and placed on the stacker tray 103. At this time, the next predetermined number of sheets of the paper bundle Pb is supplied onto the base tray 112.

In the meantime, the transfer belt 206 rotates and moves, the paper grip means 221 returns to the position in FIG. 24, and the first extended portion 201*a* of the gripper 106 and the ejector plate 215 of ejector 202 are made into a connected state, and moves towards the curved-surface cam 203*b* along the rail groove 203*a*.

When the paper grip means 221 grips the rear end of the paper bundle Pb, the ejector 202 continues to move and similarly reaches the position of the stacker tray 103 in the state of gripping, the majority of the surface of the paper bundle Pb is connected to the surface of the stacker tray 103. The ejector 202 rotates continuously and moves downward in a state where the paper bundle Pb is connected to the surface of the stacker tray 103, and therefore the first extended portion 201*a* of the gripper 106 gripping the rear end of the paper bundle Pb moves in an unchanged condition, the gripped paper bundle Pb is separated from the first extended portion 201*a*, and the gripped paper bundle Pb is lowered and placed on the stacker tray 103 repeatedly.

In this way, the paper grip means 221 is disposed on the transfer belt 206, whereby the paper bundle Pb is temporarily stacked and arranged on the base tray 112, subsequently the arranged several sheets of the paper bundle Pb can be transferred efficiently and reliably, and the processing speed can be improved.

In addition, paper grip means 221 is configured so as to grip the paper bundle Pb housed in the base tray 112 in a position corresponding to the grip-side rotating shaft 211*b*, and to lower and place the gripped paper bundle Pb on the stacker tray 103 in a position corresponding to the stacker tray-side rotating shaft 211*b*, whereby the vibration caused by the grip of the paper bundle Pb and the operation of lowering and placing the gripped paper bundle Pb on the stacker tray 103 can be reduced.

Figure 28:
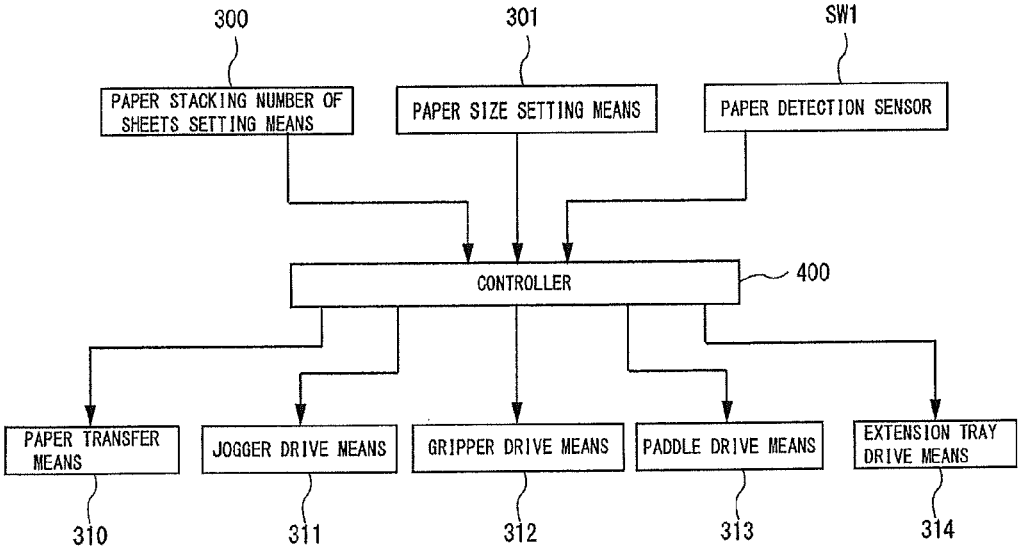
FIG. 28 is a control block diagram of the paper post-processing device.
Figure 29:
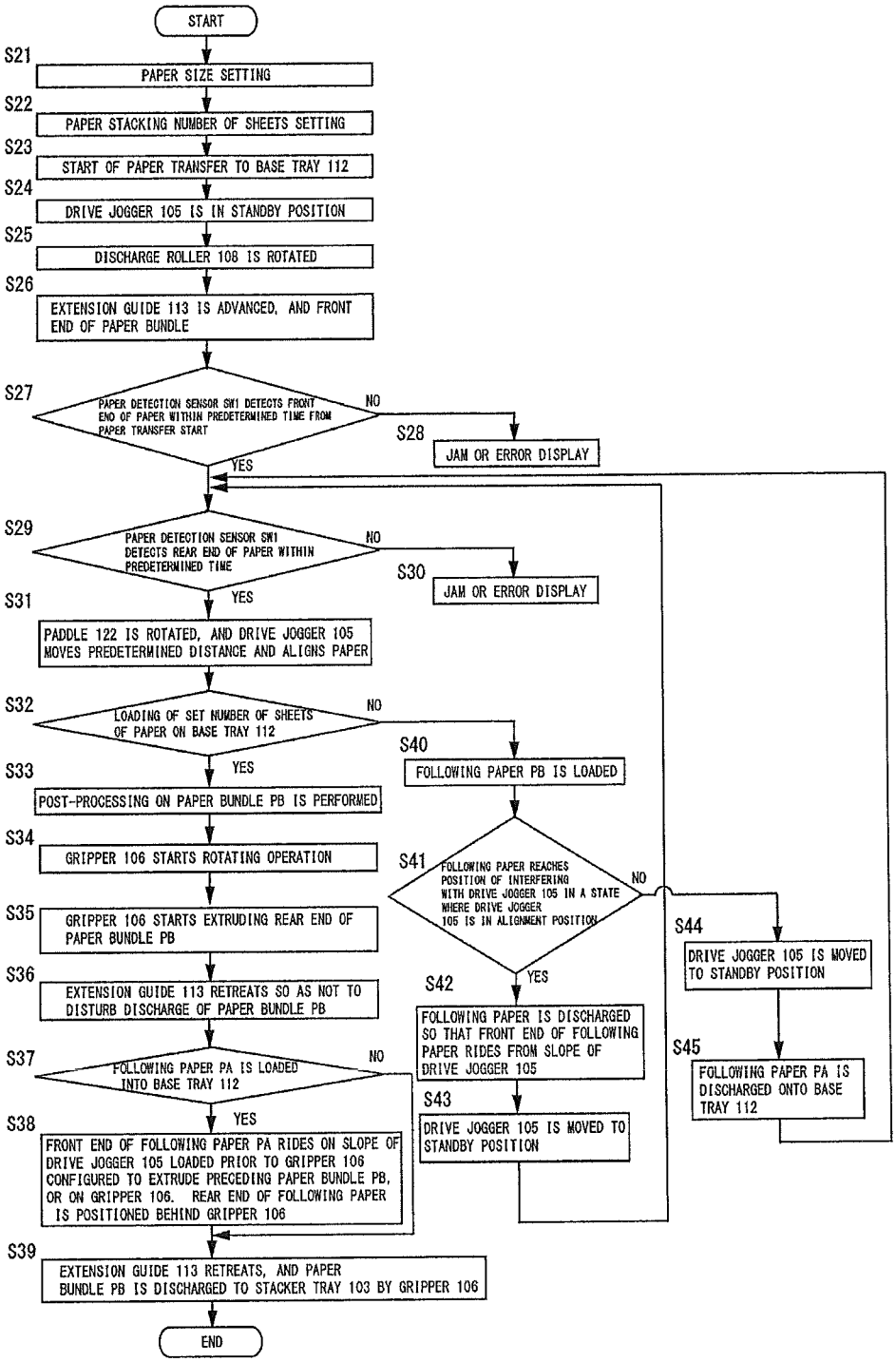
FIG. 29 is a flow chart illustrating the operation of the paper post-processing device.

The transfer interval and the speed of the paper, and the predetermined distance P to be the shift of the paper in the alignment process can be appropriately controlled and set by the control program based on the size of the paper, the paper detection sensor SW1, the rotation of the inlet roller 109 and the discharge roller 108, and the like. The present embodiment will be described with reference to FIGS. 28 and 29. FIG. 28 is a control block diagram of the paper post-processing device, and FIG. 29 is a flow chart illustrating the operation of the paper post-processing device.

The paper post-processing device 102 includes a controller 400 as shown in FIG. 28, and the controller 400 is constituted by a microcomputer, and may be configured integrally with the controller of the image-forming device 1, or may be configured separately. In addition, the paper post-processing device 102 includes a paper stacking number of sheets setting means 300 configured to set the number of sheets of paper stacked on the base tray 112, and the paper stacking number of sheets setting means 300 may be configured integrally with the operating unit of the image-forming device 1, or may be configured separately. In addition, the paper post-processing device 102 includes a paper size setting means 301 configured to set the size of the paper Pa transferred from the image forming device 1, and the paper size setting means 301 may be configured integrally with the operating unit of the image forming device 1, or may be configured separately.

Furthermore, the paper post-processing device 102 includes a paper transfer means 310, a jogger drive means 311 configured to drive the drive jogger 105, a gripper drive means 312 configured to drive the gripper 106, a paddle drive means 313 configured to drive the paddle 122, and an extension guide drive means 314 configured to drive the extension guide 113. The paper transfer means 210 is constituted by a roller and the like, includes an inlet roller 109 and a discharge roller 108, and transfers the paper transferred from the image forming device 1.

The controller 400 sets the predetermined distance P reciprocating in the paper width direction from the standby position of the drive jogger 105 based on the width direction size of the paper Pa set by the paper size setting means 301. In addition, although the paper detection sensor SW1 configured to Detect the paper transferred from the image-forming device 1 disposed in the pre-stage of the discharge roller 108, it is not limited to this position. Although the paper detection sensor SW1 uses a sensor configured to perform the contactless detection, it may use a sensor configured to perform the contacting detection.

The controller 400 controls the jogger drive means 311, the gripper drive means 312, the paddle drive means 313, and the extension guide drive means 314, based on the detection information from the paper detection sensor SW1, so that the number of sheets of paper set by the paper stacking number of sheets setting means 300 is stacked on the base tray 112 and discharged as the paper bundle Pb.

The operation of the paper post-processing device 102 is as follows as shown in FIG. 29. When the size of the paper Pa transferred from the image-forming device 1 by the paper size setting means 301 is set, the controller 400 sets the predetermined distance P reciprocating in the paper width direction from the standby position of the drive jogger 105 based on the width direction size of the paper Pa set by the paper size setting means 301 (S21). Furthermore, when the number of sheets of paper to be stacked on the base tray 112 is set by the paper stacking number of sheets setting means 300 (S22), the controller 400 transfers the paper Pa transferred from the image-forming device 1 by driving the paper transfer means 310, and starts the operation of aligning on the base tray 112 (S23). At the time of the transfer start, the drive jogger 105 is positioned in the standby position (S24).

When the paper Pa is transferred from the image-forming device 1, the transferred paper Pa is stacked in the compilation unit 104 through the inlet roller 109 and the discharge roller 108, and the discharge roller 108 is rotated (S25), the extension guide 113 is advanced by the extension guide drive means 314, and the front end of the paper bundle Pb discharged to the stacker tray 103 is made supportable (S26).

The discharge roller 108 is rotated, whereby it is determined whether or not the paper detection sensor SW1 detects the front end of the paper Pa within a predetermined time from the transfer start (S27), and the display of a jam or an error is performed if not detected (S28).

If the paper detection sensor SW1 detects the front end of the paper Pa, it is determined whether or not the rear end of the paper Pa is detected within the predetermined time (S29), and the display of a jam or an error is performed if not detected (S30). If the rear end of the paper Pa is detected within the predetermined time, the paddle 122 is rotated by the paddle drive means 313, and the drive jogger 105 moves the predetermined distance P in the paper width direction from the standby position and aligns the paper Pa by the jogger drive means 311 (S31).

It is determined whether or not the set number of sheets of paper Pa is loaded on the base tray 112 (S32), and if the loading is completed, the post-processing on the paper bundle Pb is performed (S33), the gripper 106 starts the rotating operation by the gripper drive means 312 (S34), and in a position corresponding to the grip-side rotating shaft 211*b*, the rear end of the paper bundle Pb housed in the base tray 112 is gripped and starts being extruded toward the stacker tray 103 side (S35). The extension guide 113 being advanced by the extension guide drive means 314 retreats so that it does not disturb the paper bundle Pb to be discharged to the stacker tray 103 (S36).

It is determined whether or not the following paper Pa is transferred onto the base tray 112 by the detection of the paper detection sensor SW1 in this condition (S37), and if the following paper Pa is transferred onto the base tray 112, the front end of the following paper Pa rides from the slope 50 of the drive jogger 105 loaded prior to the gripper 106 configured to extrude the preceding paper bundle Pb, or from the gripper 106. The rear end of the following paper Pa is positioned behind the gripper 106 (S38).

The extension guide 113 retreats by the drive of the extension guide drive means 314, and the paper bundle Pb is discharged to the stacker tray 103 by the gripper 106 (S39). Even if the following paper Pa is not transferred onto the base tray 112 (S37), the extension guide 113 retreats to be positioned in the standby position by the drive of the extension guide drive means 314, and the paper bundle Pb is discharged to the stacker tray 103 by the gripper 106 (S39).

If the set number of sheets of the paper Pa is not loaded on the base tray 112 (S32), the following paper Pa is loaded (S40), and it is determined whether or not the following paper Pa reaches the position of interfering with the drive jogger 105 in a state where the drive jogger 105 is in the alignment position (S41).

If the following paper Pa reaches the position of interfering with the drive jogger 105, the following paper Pa is discharged so that the front end of the following paper Pa rides from the slope 50 of the drive jogger 105 (S42), and the drive jogger 105 is moved to the standby position (S43). Then, if the paper detection sensor SW1 detects the front end of the following paper Pa, the process proceeds to the step of determining whether or not the rear end of the following paper Pa is detected within the predetermined time (S29).

In addition, if the following paper Pa does not reach the position of interfering with the drive jogger 105 (S41), the drive jogger 105 is moved to the standby position (S44), the following paper Pa is discharged onto the base tray 112 (S45), and if the paper detection sensor SW1 detects the front end of the following paper Pa, the process proceeds to the step of determining whether or not the rear end of the following paper Pa is detected within the predetermined time (S29), and the operation described above is repeated.

In the present embodiment, the controller 400 controls the jogger drive means 311 based on the detection information from the paper detection sensor SW1, moves the drive jogger 105 a predetermined distance P in the paper width direction from the standby position in the state where the paper Pa is stacked on the base tray 112, aligns the paper Pa stacked on the base tray 112 is in the position within the surface area of the following paper Pa transferred from the image-forming device 1, places the following paper Pa on the upper surface of the drive jogger 105 in the state where the drive jogger 105 aligns the paper Pa, stacks the following paper Pa placed on the top surface of the drive jogger 105 on the base tray 112 by moving the drive jogger 105 toward its original standby position in the state where the following paper Pa is placed on the top surface of the drive jogger 105 or on the gripper 106, repeats the operation of the drive jogger 105 reciprocating the predetermined distance P in the paper width direction from the standby position, stacks the paper Pa on the base tray 112 by aligning the set number of sheets of paper, and can transfer them at a high speed to stack by utilizing the operation of the drive jogger 105 so that the paper Pa on the base tray 112 and the following paper Pa do not interfere with each other.

In addition, the controller 400 can stack various sizes of paper on the base tray 112 by aligning the set number of sheets of paper by setting the predetermined distance P of reciprocating in the paper width direction from the standby position of the drive jogger 105 based on the width direction size of the paper Pa set by the paper size setting means 301.

In addition, when the paper detection sensor SW1 detects the front end of the paper Pa and detects the rear end of the paper Pa within a predetermined time, the controller 400 rotates the paddle 122 by the paddle drive means 313, controls the transfer of the following paper Pa to the front and aligns the end surface of the rear end of the paper bundle Pb by the paddle 122 being brought into contact with the following paper Pa, and aligns the paper Pa by the drive jogger 105 moving the predetermined distance P by the gripper drive means 311, whereby the paper bundle Pb can be reliably aligned without the following paper Pa and the paper bundle Pb interfering with each other.

In addition, when the paper detection sensor SW1 detects the front end of the paper, the controller 400 advances the extension guide 113, makes the front end of the paper bundle Pb discharged onto the stacker tray 103 supportable, grips the rear end of the paper bundle Pb by the gripper 106 to extrude after the set number of sheets of paper is aligned on the base tray 112 and stacked, retracts the extension guide 113 to the standby position while supporting the paper bundle Pb by the advanced extension guide 113, discharges the paper bundle Pb on the base tray 112 onto the stacker tray 103, and when the paper detection sensor SW1 detects the front end of the paper after the paper bundle Pb is discharged onto the stacker tray 103, the extension guide 113 is advanced, and in a compact structure making the front end of the paper bundle Pb discharged onto the stacker tray 103 supportable, and furthermore, the extension guide 113 is in a state of retracting and being positioned in the standby position only when the gripper 106 completes the discharge of the paper bundle Pb onto the stacker tray 103, the controller 400 can reliably support the paper bundle Pb to discharge onto the stacker tray 103.

In addition, when the following paper Pa following the paper bundle Pb to be discharged onto the stacker tray 103 is transferred onto the base tray 112, the front end of the following paper Pa rides on the drive jogger 105 or the gripper 106 and precedes the gripper 106 configured to extrude the preceding paper bundle Pb, the rear end of the following paper Pa is positioned behind the gripper 106, the extension guide 113 retracts, and the paper bundle Pb is discharged onto the stacker tray 103 by the gripper 106, whereby the following paper Pa and the gripper 106 do not interfere with each other, and furthermore, the extension guide 113 does not disturb the discharge of the paper bundle Pb due to the retraction of the extension guide 113, and the paper bundle Pb can be smoothly discharged onto the stacker tray 103.

(Second Embodiment)

Figure 30:
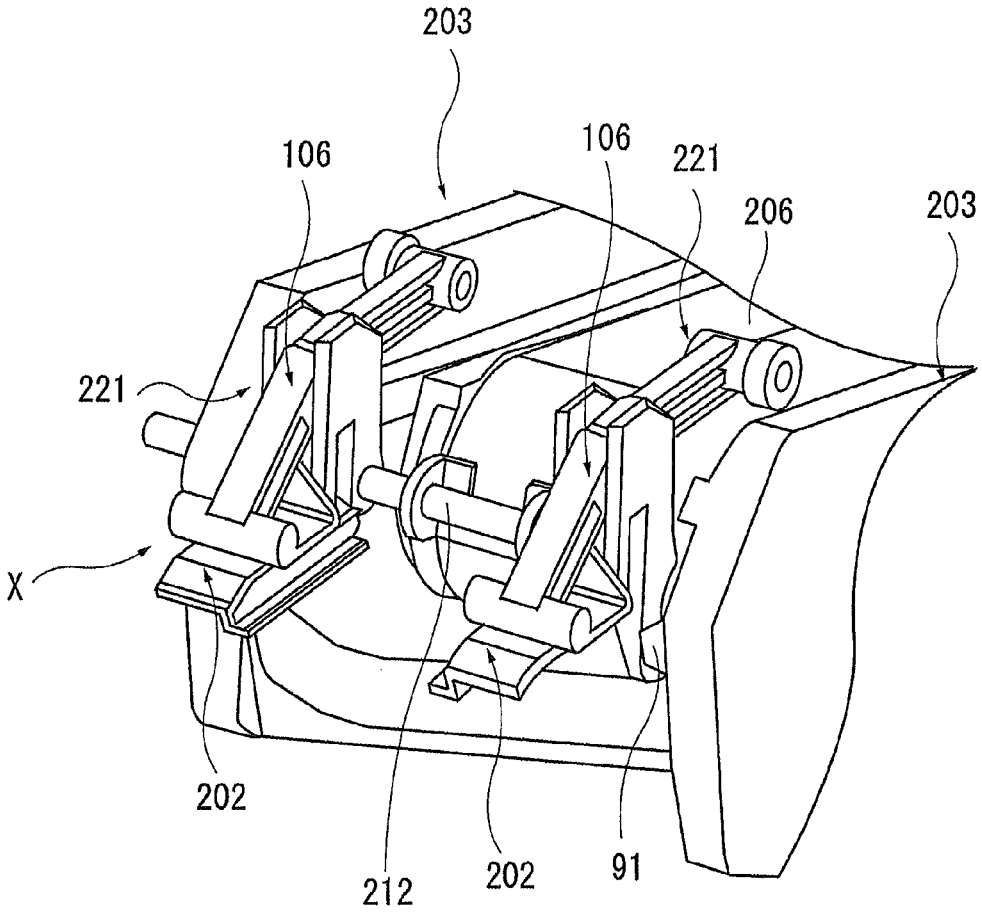
FIG. 30 is a perspective view showing the paper discharge side of the paper-stacking device.
Figure 31:
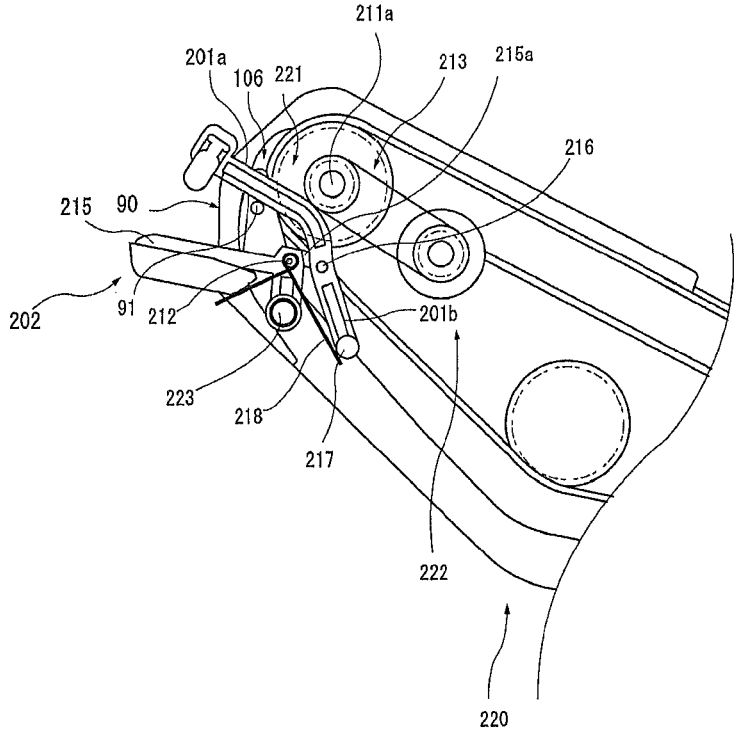
FIGS. 31(*a*) and 31(*b*) are structural diagrams of the grip release of the paper-stacking device.
Figure 31:
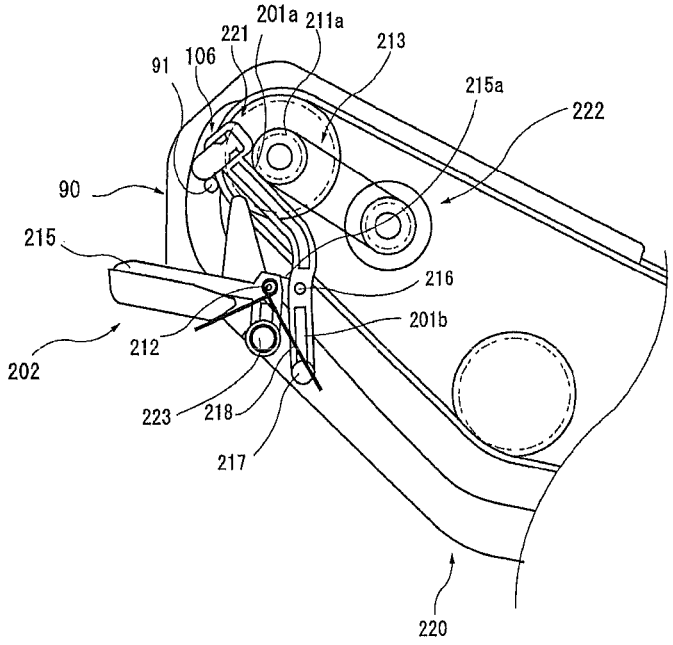

The paper post-processing device of the present embodiment will be described with reference to FIGS. 30 to 40(*b*). FIG. 30 is a perspective view showing the paper discharge side of the paper stacking device, FIGS. 31(*a*) and 31(*b*) are structural diagrams of the grip release of the paper stacking device, FIG. 32(*a*) to 32(*c*) are side views showing the operation of the grip release of the paper stacking device, and FIGS. 33 to 38 are operation process explanatory diagrams of the paper stacking device. The paper post-processing device of the present embodiment includes a grip release means 90, and the configuration of the grip release means 90 will be described with reference to FIGS. 30 to 32(*c*). By using the transfer of the paper grip means 221, the grip release means 90 releases the grip by the ejector 202 and the gripper 106, and arranges the paper in the stacker tray 103 to stack.

The grip release means 90 of the present embodiment includes a release guide member 91 disposed in the device main body X, and the release guide member 91 includes the protrusion disposed in the guide side plate 203. The paper bundle Pb is gripped by the ejector 202 and the gripper 106 to be transferred by the paper grip means 221 (FIG. 32(*a*)), the gripper 106 abuts against the release guide member 91 by the transfer (FIG. 32(*b*)), and furthermore, the gripper 106 is transferred while abutting against the release guide member 91, and for this reason, the gripper 106 moves in a direction away from the ejector 202 against the spring force of the spring 218.

Figure 32:
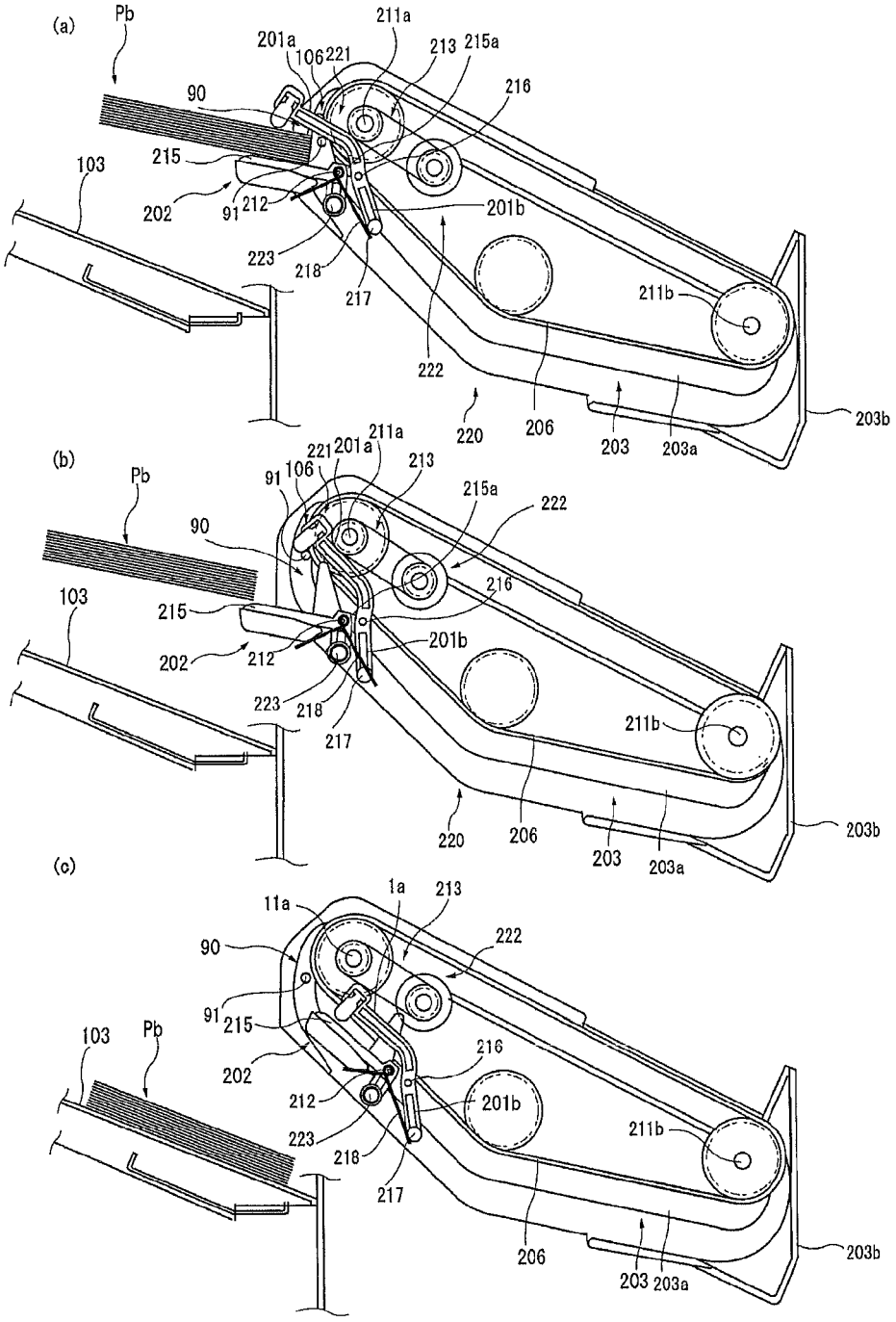
FIGS. 32(*a*) to 32(*c*) are side views showing the operation of the grip release of the paper stacking device.

The grip of the paper bundle Pb by the ejector 202 and the gripper 106 is released due to the direction where the gripper 106 is spaced apart (FIG. 32(*c*)), and furthermore, the gripper 106 is transferred, whereby the paper bundle Pb drops tobe stacked on the stacker tray 103. Then, the gripper 106 comes off after climbing over the release guide member 91, and returns to its original position by the spring force of the spring 218 to be transferred by the paper grip means 221.

Thus, the transfer of the paper grip means 221 releases the grip by the ejector 202 and the gripper 106 and arranges the paper Pa on the stacker tray 103 to stack, and therefore the paper Pa is not bent (turned up) even when the paper Pa is in contact with the wall surface, and can stack the paper Pa on the stacker tray 103 without being damaged.

The present embodiment has the configuration of transferring the gripper 106 while causing the gripper 106 to abut against the release guide member 91 by the paper grip means 221, and of releasing the grip by the ejector 202 and the gripper 106, the release guide member 91 is a protrusion disposed on the guide side plate 3 constituting the device main body X, and the grip can be released by the simple structure of only including the release guide member 91.

Next, the operation process of the paper stacking device in the paper post-processing device 102 will be described in detail with reference to FIGS. 33 to 38.

Figure 33:
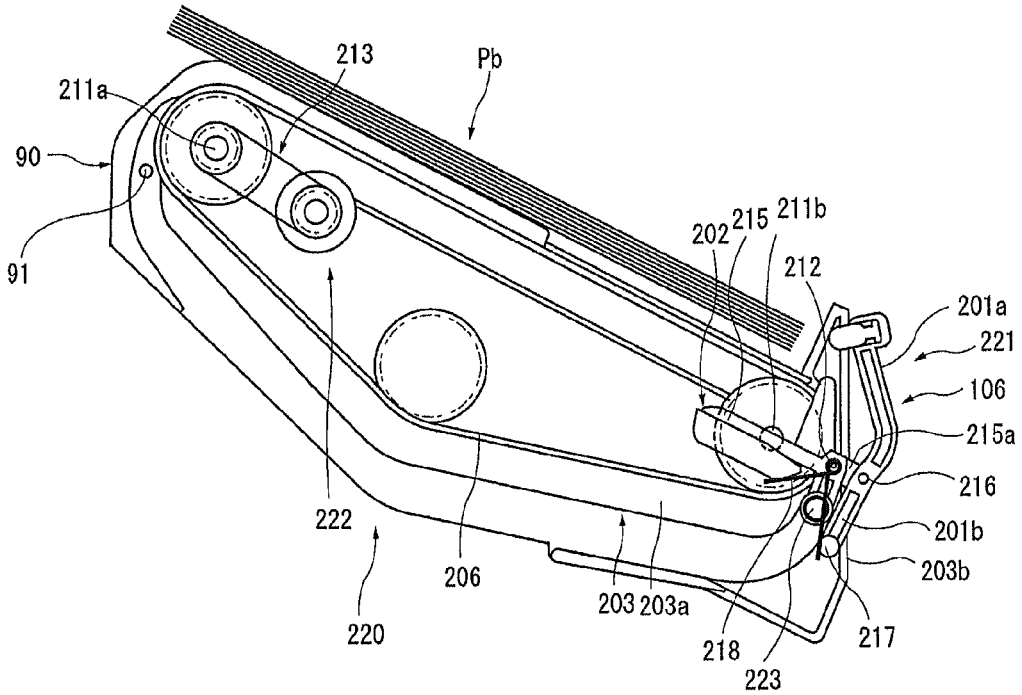
FIG. 33 is an operation process explanatory diagram of the paper-stacking device.

As shown in FIG. 33, in the initial stage, the boss 217 is positioned in the base point of the curved-surface cam 203*b* of the guide side plate 203, and the boss 217 is pushed toward the inside while moving along the curved-surface cam 203*b*, and therefore the ejector plate 215 and the first extended portion 201*a* of the gripper 106 connected by the spring 218 are spaced apart, and it comes into a state where the paper bundle Pb can be gripped.

The copying of the digital output device begins in this state, and when a predetermined number of sheets of the paper Pa is housed in the paper stacking plate 205, the drive motor 207 is made to rotate by detecting the signal, the rotating power of the drive motor 207 is transmitted to the grip-side rotating shaft 211*b* and the stacker tray-side rotating shaft 211*a*, and the transfer belt 206 mounted on the grip-side rotating shaft 211*b* and the stacker tray-side rotating shaft 211*a* is rotated and moved.

Figure 34:
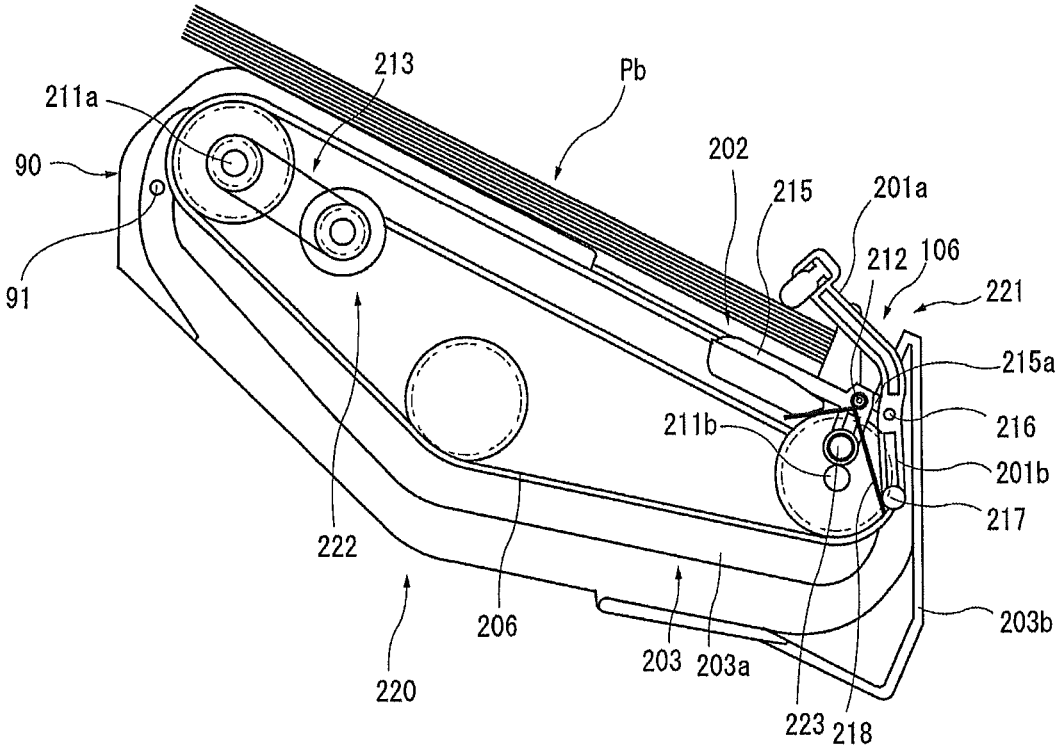
FIG. 34 is an operation process explanatory diagram of the paper-stacking device.

By the movement of the transfer belt 206, the ejector 202 fitted and fixed in the fixed shaft 212 moves about a predetermined interval along the rail groove 203*a*. At this time, as shown in FIG. 34, when the ejector 202 of one paper grip means 221 moves and the boss 217 of the gripper 106 is released from the area of the curved-surface cam 203*b*, the gripper 106 coupled with the ejector 202 by the hinge portion 216 returns to its original position by the restoring force of the spring 218.

Figure 35:
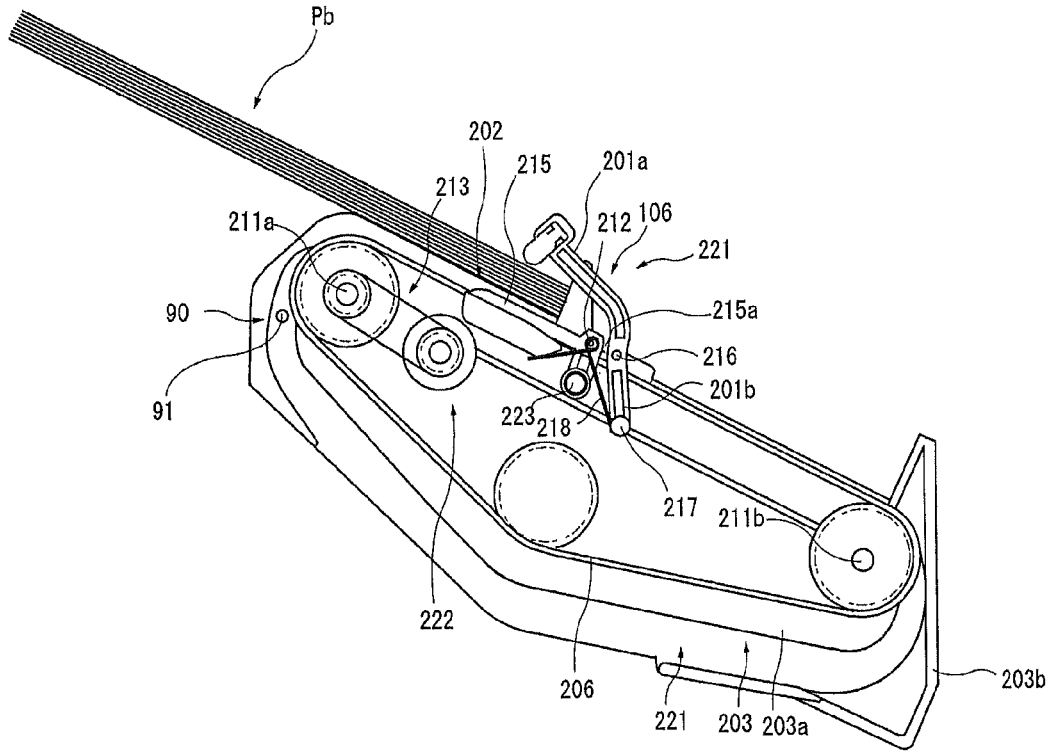
FIG. 35 is an operation process explanatory diagram of the paper-stacking device.

When returned to its original position, the gripper 106 grips the stacked paper bundle Pb, and in a state of gripping the paper bundle Pb as shown in FIG. 35, the ejector 202 moves along the rail groove 203*a*.

Figure 36:
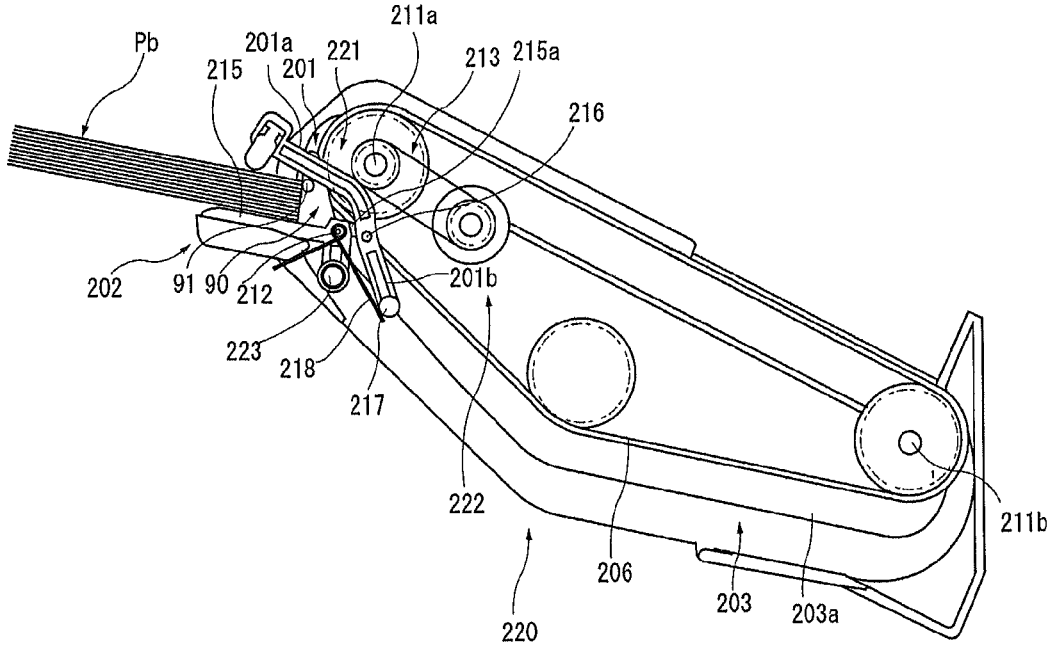
FIG. 36 is an operation process explanatory diagram of the paper-stacking device.
Figure 37:
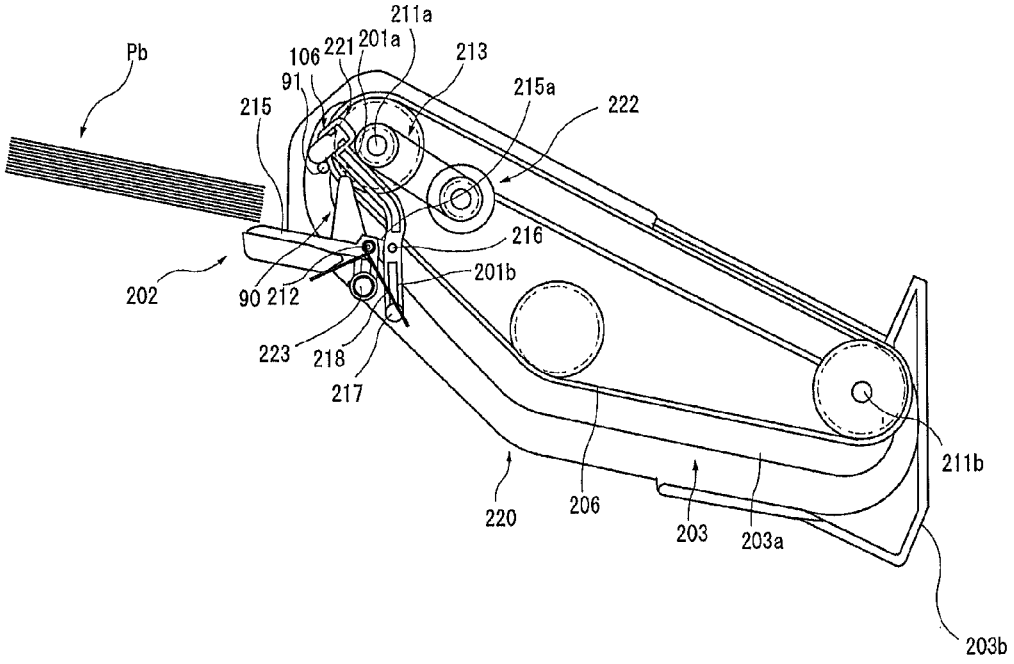
FIG. 37 is an operation process explanatory diagram of the paper-stacking device.

When the ejector 202 continues to move and reaches the position of the stacker tray 103 in a state where the paper grip means 221 grips the paper bundle Pb as shown in FIG. 36, the majority of the surface of the paper Pa is connected to the surface of the stacker tray 103. The ejector 202 rotates continuously and moves downward in a state where the paper Pa is connected to the surface of the stacker tray 103, and therefore the first extended portion 201*a* of the gripper 106 gripping the end portion of the paper bundle Pb moves in an unchanged condition, the gripper 106 abuts against the release guide member 91 by the transfer, and furthermore, the gripper 106 is transferred while abutting against the release guide member 91. For this reason, as shown in FIG. 37, the gripper 106 moves so as to be separated from the ejector 202 against the spring force of the spring 218, the gripped paper bundle Pb is separated from the first extended portion 201*a*, the gripper 106 drops the gripped paper Pa on the stacker tray 103, and the paper is not bent (turned up) even when the paper is in contact with the wall surface, and the gripper 106 can stack the paper on the stacker tray 103 without damaging the paper.

Figure 38:
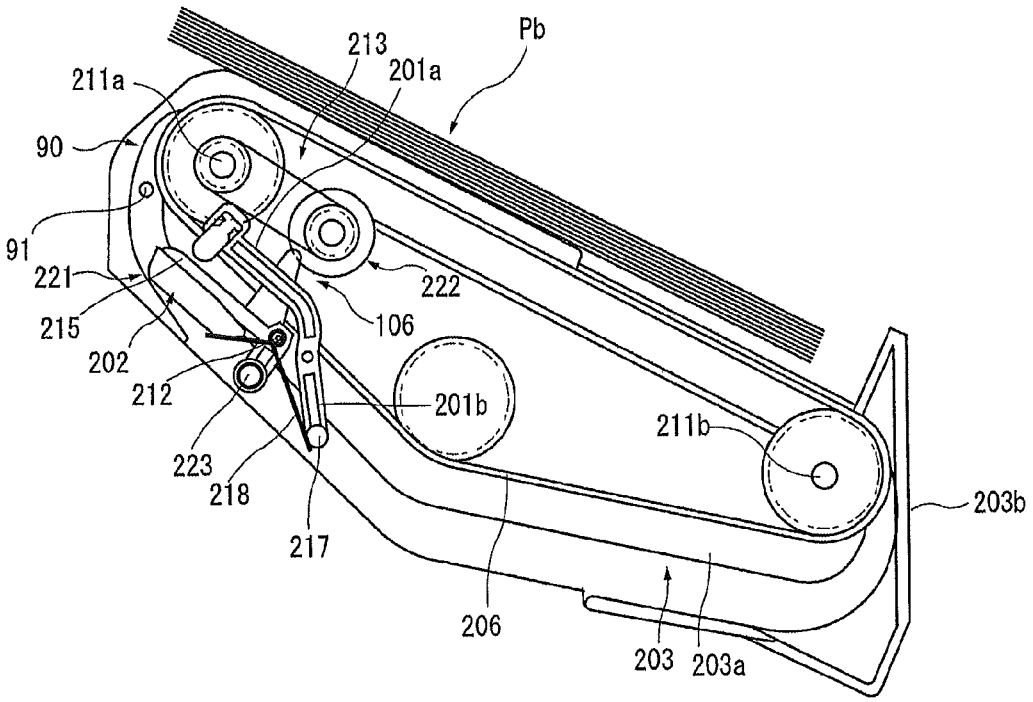
FIG. 38 is an operation process explanatory diagram of the paper-stacking device.

The gripped paper bundle Pb is transferred to the stacker tray 103, as shown in FIG. 38, the paper grip means 221 is made to be in a state where the first extended portion 201*a* of the gripper 106 and the ejector plate 215 of ejector 202 are connected to each other, the paper grip means 221 moves towards the curved-surface cam 203*b* along the rail groove 203*a*, and the operation of becoming the state in FIG. 33 is repeated.

(Third Embodiment)

Figure 39:
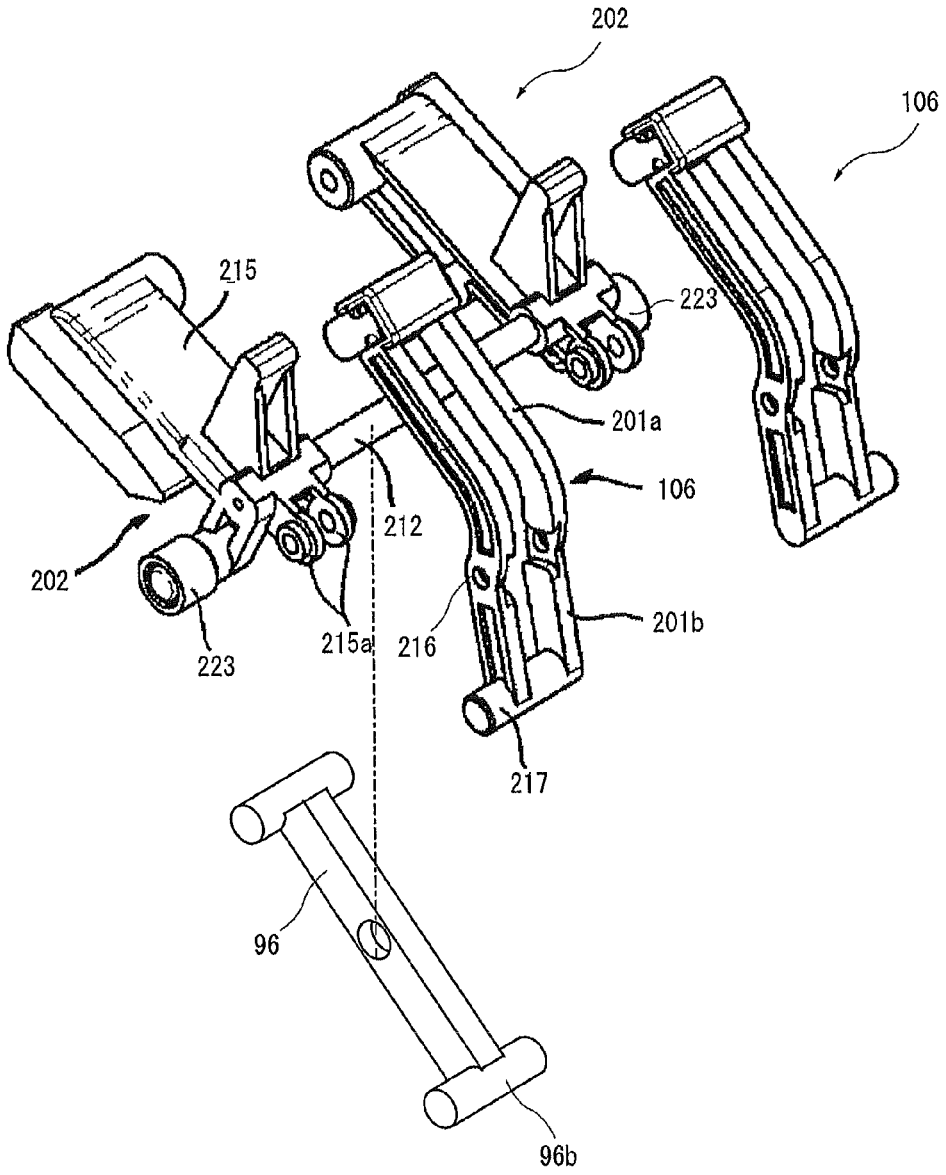
FIG. 39 is a principal part explanatory diagram of the fixed shaft where the ejector of the paper-stacking device is fixed.

The present embodiment will be described with reference to FIGS. 39 and 40(*a*) and 40(*b*). FIG. 39 is a principal part explanatory diagram of the fixed shaft where the ejector of the paper stacking device is fixed, and FIGS. 40(*a*) and 40(*b*) are explanatory diagrams of the grip release of the paper stacking device. The grip release means 90 of the present embodiment is different from that of the second embodiment. Although the grip release means 90 of the present embodiment includes a release guide member 91 disposed in the device main body X similarly to the second embodiment, the paper grip means 221 includes a release lever 96 for releasing the grip of the gripper 106. The release lever 96 is rotatably disposed on the fixed shaft 212, and one end portion 96*a* abuts against the release guide member 91, whereby the release lever 96 has a configuration that the other end portion 96*b* is rotated so as to separate the gripper 106 from the ejector 202 by the release lever 96 being rotated. The release guide member 91 includes a guide protrusion disposed on the guide side plate 203.

Figure 40:
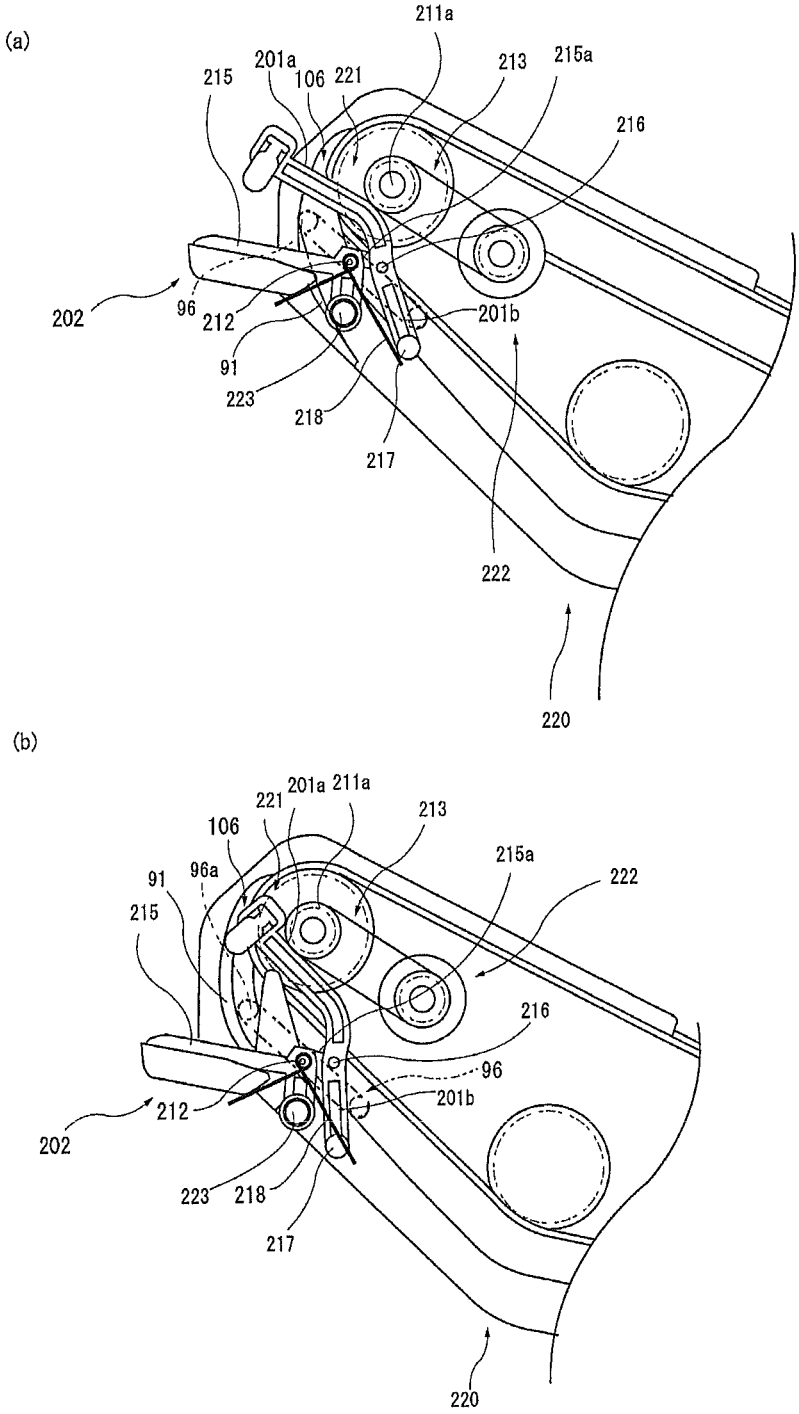
FIGS. 40(*a*) and 40(*b*) are explanatory diagrams of the grip release of the paper-stacking device.

In the present embodiment, the gripped paper bundle Pb is transferred to the stacker tray 103 by the paper grip means 221, and furthermore, when the one end portion 96*a* of the release lever 96 is transferred while abutting against the release guide member 91, this transfer rotates the release lever 96, and the other end portion 96*b* rotates so as to separate the gripper 106 from the ejector 202 (FIG. 40(*a*)). Thus, the grip by the ejector 202 and the gripper 106 is released by using the release lever 96, whereby the gripped paper bundle Pb is dropped on the stacker tray 103, the paper is not bent (turned up) even when the paper is brought into contact with the wall surface, and the paper can be stacked on the stacker tray 103 without being damaged (FIG. 40(*b*)). In the present embodiment, the grip can be released by the simple structure of only including the release guide member 91 and the release lever 96 configured to separate the gripper 106 from the ejector 202.

(Fourth Embodiment)

(First Configuration of Paper Grip Transfer Means, Paper Guide Transfer Means, and Drive Means)

Figure 41:
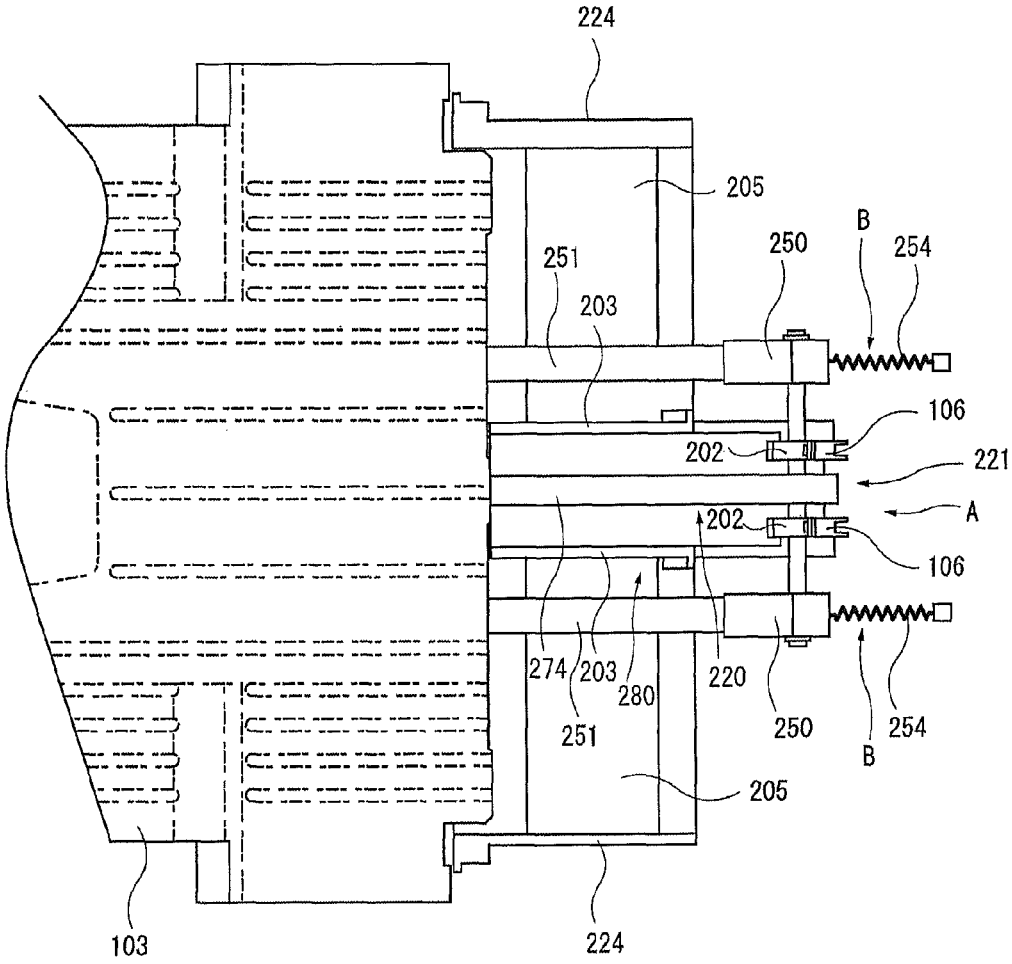
FIG. 41 is a plan view of the paper stacking in the paper post-processing device.
Figure 42:
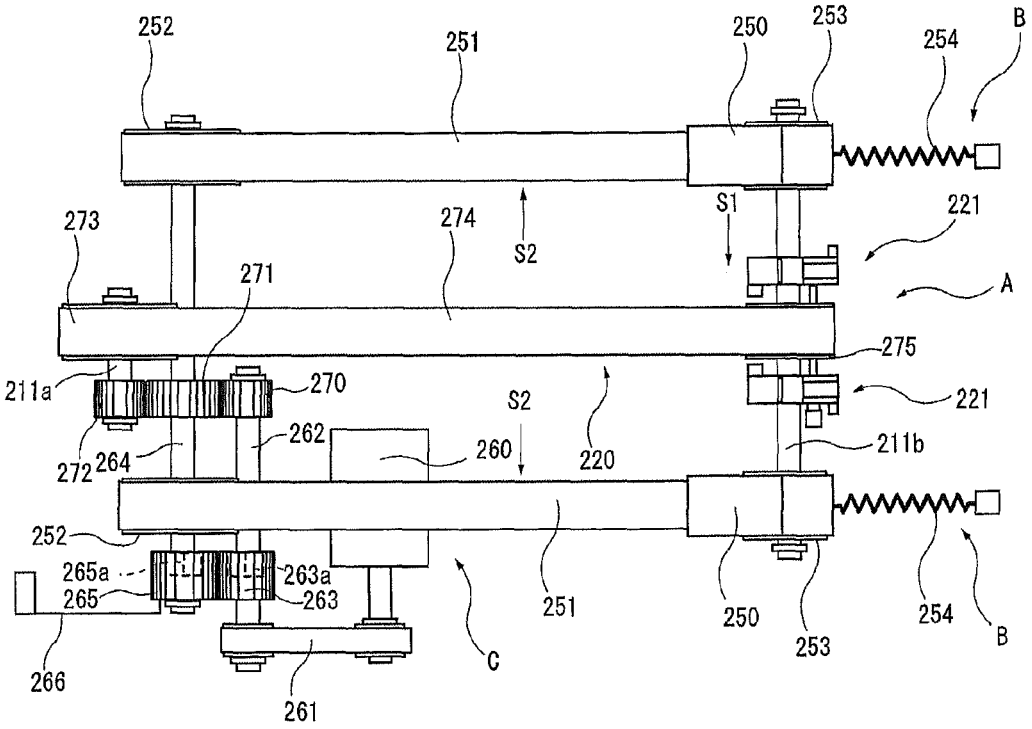
FIG. 42 is a plan view showing a first overall configuration.
Figure 43:
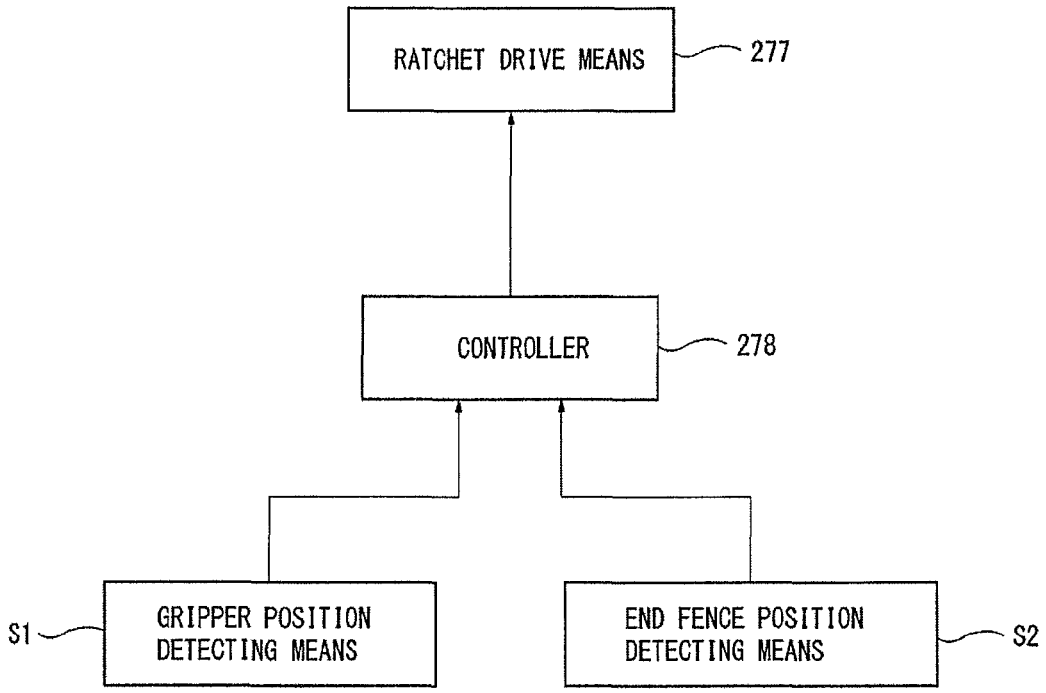
FIG. 43 is a block diagram of the control.
Figure 44:
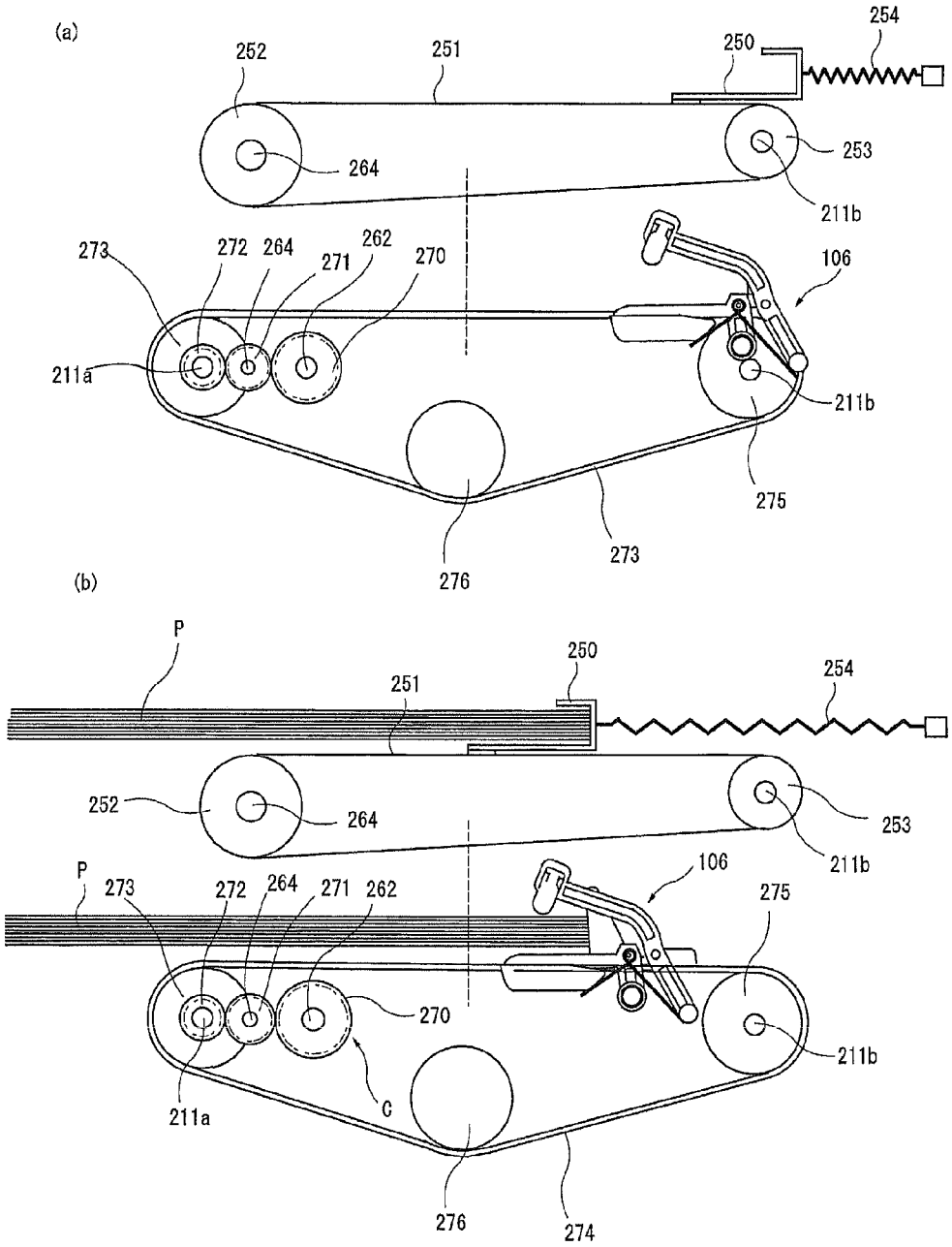
FIGS. 44(*a*) and 44(*b*) are diagrams illustrating the operation.

The first configuration of the paper grip transfer means, the paper guide transfer means, and the drive means will be described with reference to FIGS. 41 to 44(*b*). FIG. 41 is a plan view of the paper stacking in the paper post-processing device, FIG. 42 is a plan view showing the overall configuration, FIG. 43 is a block diagram of the control, and FIGS. 44(*a*) and 44(*b*) are diagrams illustrating the operation.

The paper post-processing device 102 of the present embodiment includes a stacker tray 103 in the device main body X, and arranges the paper on the stacker tray 103 to stack, and the device main body X includes a paper stacking plate 205 configured to temporarily house the paper, a paper grip transfer means A configured to grip several sheets of paper P housed in the paper stacking plate 205 to transfer, and to release the grip in the discharge position to stack the paper P on the stacker tray 103, a paper guide transfer means B configured to hold the rear end portion of the several sheets of paper housed in the paper stacking plate 205 to transfer, and a drive means C configured to link the paper grip transfer means A and the paper guide transfer means B to drive by a single drive source.

The paper grip transfer means A includes the paper transfer means 220 and the grip means 221 described above, the paper guide transfer means B are disposed on both sides of the paper grip transfer means A, and the paper post-processing device 102 has a configuration of holding the paper to transfer by the paper guide transfer means B disposed on both sides and the paper grip transfer means A disposed in the middle, and can transfer the paper to stack on the stacker tray without damaging the paper and without shifting the paper by holding both sides of the gripped paper.

The paper guide transfer means B includes an end fence 250 configured to hold the rear end portion of the paper and an end fence belt 251, and the end fence 250 is fixed to the end fence belt 251, and is made movable by the end fence belt 251.

The single drive source 260 provided in the drive means C is constituted by a motor, and the rotation of the drive source 260 is transmitted to the first drive shaft 262 through the drive belt 261. A drive gear 263 is provided on the first drive shaft 262, and the drive gear 263 engages with the drive gear 265 provided on the second drive shaft 264. The rotation of the first drive shaft 262 is transmitted to the second drive shaft 264 through the drive gears 263 and 265.

A grip drive gear 270 is provided on the first drive shaft 262, and the rotation of the grip drive gear 270 is transmitted to the belt drive gear 272 through an intermediate gear 271. The intermediate gear 271 is rotatably provided on the second drive shaft 264, and the drive roller 273 is coaxially provided on the belt drive gear 272. A gripper belt 274 is driven by the drive roller 273, and the gripper belt 274 is bridged between a driven roller 275 and a tension roller 276.

The drive roller 252 is provided on the second drive shaft 264, and the end fence belt 251 is bridged between the drive roller 252 and the driven roller 253. The drive roller 252 is rotated by being linked with the rotation of the second drive shaft 264, and the end fence belt 251 is moved through the end fence belt 251. The end fence belt 251 is energized to return to the initial position K1 by the spring 254, and the initial position K1 is the position where several sheets of paper housed on the paper stacking plate 205 are aligned.

A one-way clutch 263*a* is provided on the drive gear 263, a one-way clutch 265*a* is provided on the drive gear 265, the first drive shaft 262 is made to rotate even when the rotation of the drive gear 265 is stopped by the ratchet 266, and the drive gear 265 is made not to reversely rotate even when the second drive shaft 264 reversely rotates.

The ratchet 266 is driven by a ratchet drive means 277, and the ratchet drive means 277 is controlled by the controller 278. To the controller 278, the gripper position detection information is transmitted from the gripper position detecting means S1, and the end fence position detection information is transmitted from the end fence position detecting means S2, and the controller 278 controls the ratchet drive means 277 to stop or allow the rotation of the drive gear 265 based on the gripper position detection information and the end fence position detection information.

Next, the operation of the paper grip transfer means A, the paper guide transfer means B, and the drive means C will be described. The end fence 250 provided in the paper guide transfer means B sets the position where the several sheets of paper housed on the paper stacking plate 205 are aligned as the initial position K1, and holds the rear end portion of the paper to stop in a state of being accurately aligned.

When the single drive source 260 provided in the drive means C is driven, the rotation of the drive source 260 is transmitted to the first drive shaft 262 through the drive belt 261, and furthermore transmitted from the drive gear 263 to the drive gear 265, but the rotation of the drive gear 265 is stopped by the ratchet 266, and the second drive shaft 264 does not rotate. Therefore, the end fence 250 keeps the position for gripping the paper stopped in the initial position K1.

When the first drive shaft 262 rotates, this rotation is transmitted to the belt drive gear 272 through the grip drive gear 270 and the intermediate gear 271, the gripper belt 274 is driven by the drive roller 273 coaxially provided on the belt drive gear 272, and the gripper 106 reaches the predetermined position, the gripper position detecting means S1 detects the position of the gripper 106, and the gripper position detection information is transmitted to the controller 278.

The controller 278 controls the ratchet drive solenoid 277 based on the gripper position detection information, and releases the rotation stop of the drive gear 265 by the ratchet 266. Thus, the second drive shaft 264 starts rotating, and transfers the end fence 250 stopped in the initial position K1 by being linked with the paper grip transfer means A, and the gripper 106 and the end fence 250 are synchronized. The end fence 250 holds the rear end portion of the several sheets of paper to transfer to the gripping position K2 for gripping the paper by the paper grip transfer means A, the gripper 106 grips the paper in the gripping position K2 to transfer, and the end fence position detection information is transmitted from the end fence position detecting means S2 to the controller 278. The controller 278 controls the ratchet drive solenoid 277 to stop the rotation of the drive gear 265 based on the end fence position detection information.

For this reason, the end fence 250 returns to the initial position K1 by the spring 254. At this time, although the second drive shaft 264 is reversely rotated by the end fence belt 251, the drive gear 265 is made not to reversely rotate even when the second drive shaft 264 is reversely rotated by the one-way clutch 265*a* of the drive gear 265, the linkage is released and the end fence 250 is allowed to return to the initial position K1, and thereafter, the gripper 106 can transfer the paper and arrange the paper on the stacker tray 103 to stack. Thus, in the initial position K1, the end fence 250 is transferred by being linked with the paper grip transfer means A, the release of the linkage is performed at the timing of gripping the paper to transfer, or subsequently, by the gripper 106 of the paper grip transfer means A, and the end fence 250 is returned to the initial position K1 by the release of the linkage.

After the paper is arranged on the stacker tray 103 to be stacked, although the rotation of the drive gear 265 is stopped by the ratchet 266, and the second drive shaft 264 does not rotate, the end fence 250 returns the position for gripping the paper to the initial position K1 and remains stopped.

When the next paper is housed in the paper stacking plate 205, the first drive shaft 262 continues to rotate, whereby the gripper position detecting means S1 detects the position of the gripper 106 as described above, in the same manner as the gripper position detection information is transmitted to the controller 278, the next paper can be arranged on the stacker tray 103 to be stacked.

(Second Configuration of Paper Grip Transfer Means, Paper Guide Transfer Means, and Drive Means)

Figure 45:
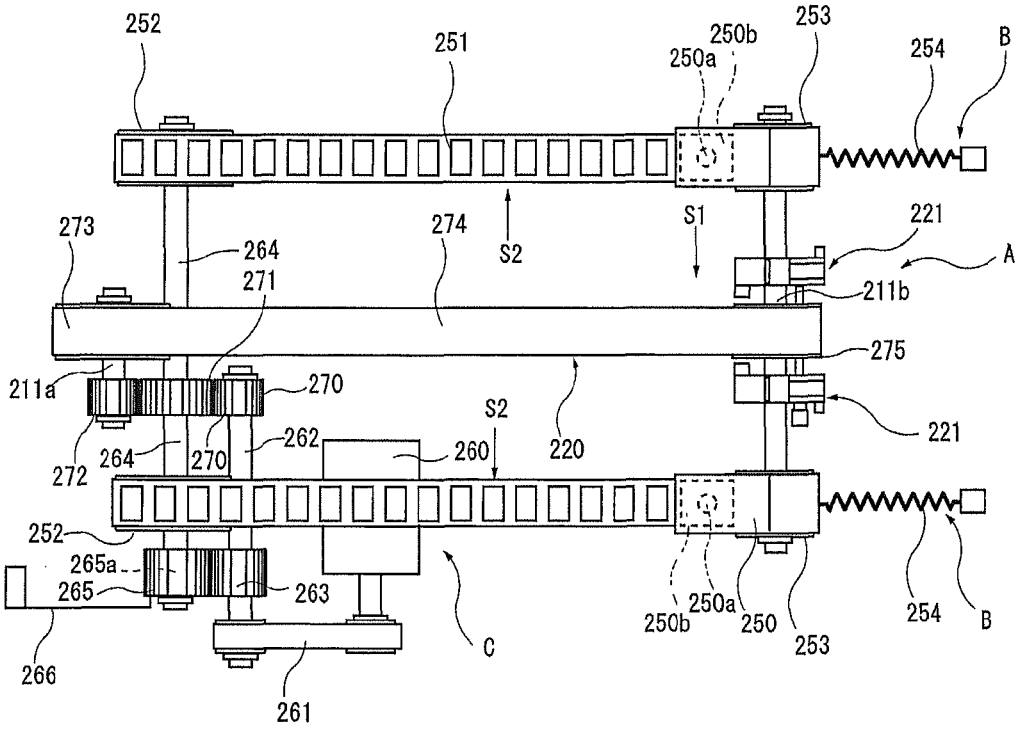
FIG. 45 is a plan view showing a second overall configuration.
Figure 46:
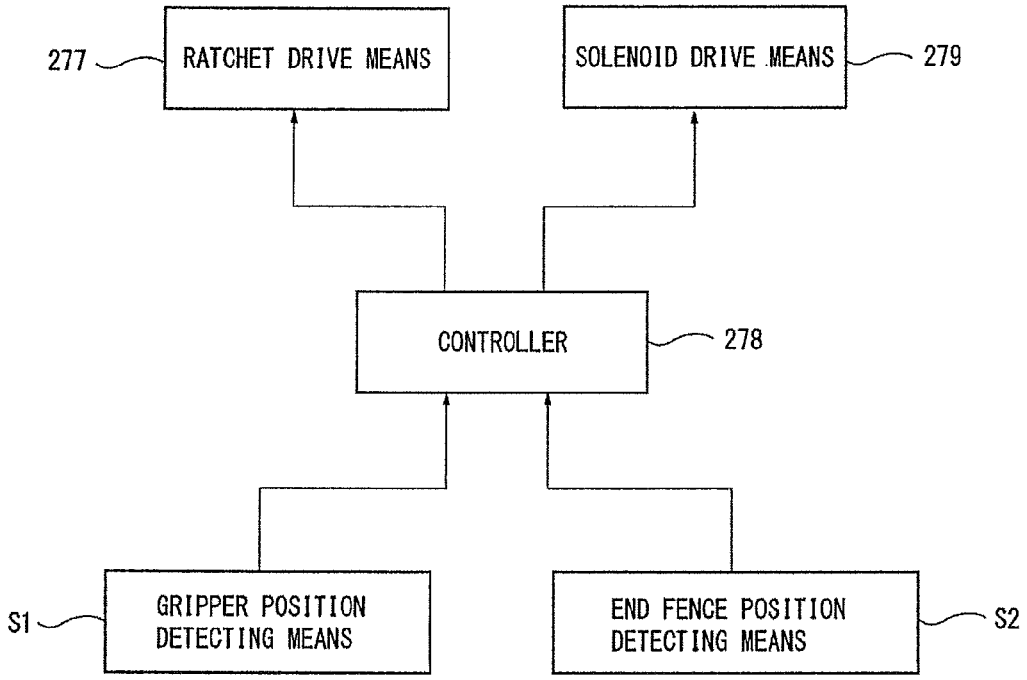
FIG. 46 is a block diagram of the control.
Figure 47:
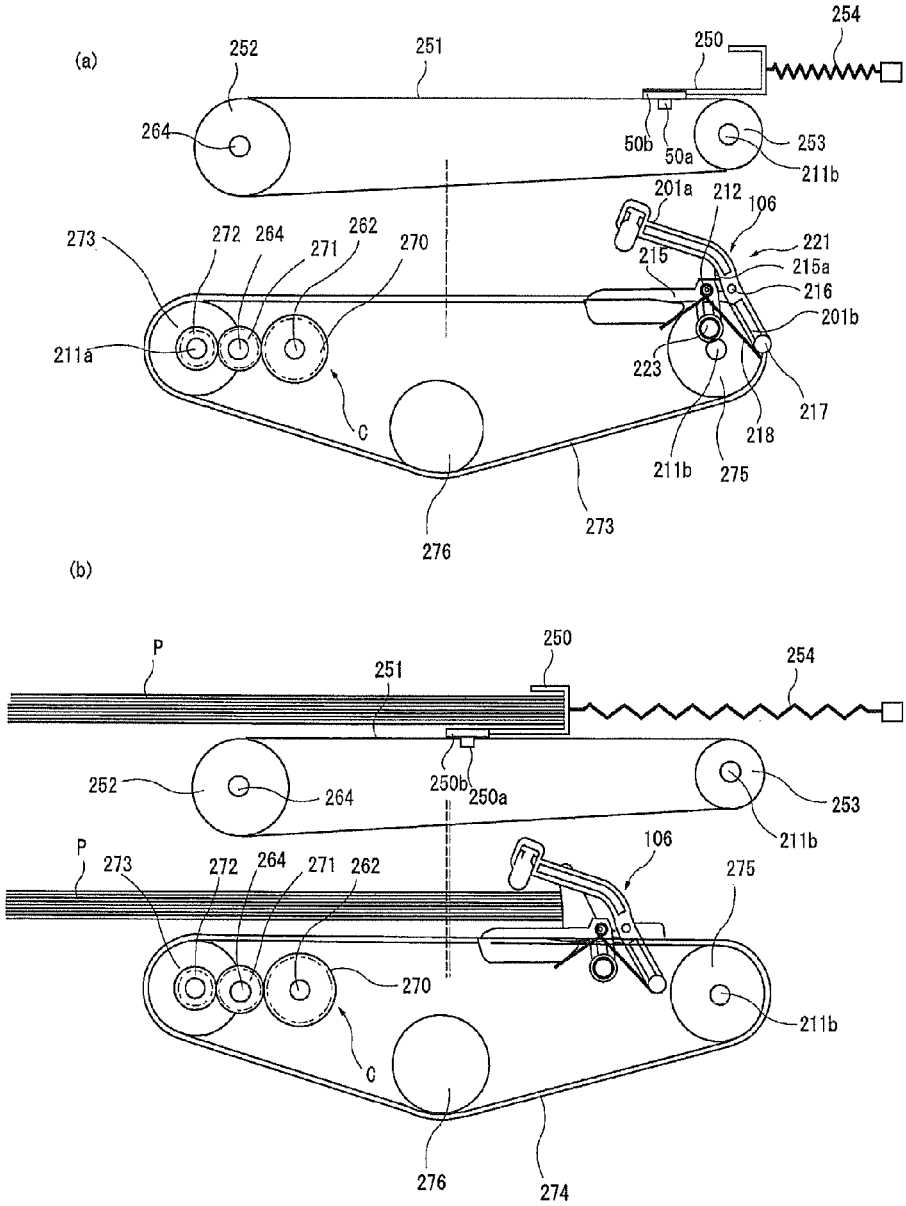
FIGS. 47(*a*) and 47(*b*) are diagrams illustrating the operation.

The second configuration of the paper grip transfer means, the paper guide transfer means, and the drive means will be described with reference to FIGS. 45 to 47(*b*). FIG. 45 is a plan view showing the overall configuration, FIG. 46 is a block diagram of the control, and FIGS. 47(*a*) and 47(*b*) are diagrams illustrating the operation.

In the present embodiment, the same configuration as the first configuration will be denoted by the same reference numerals, and the description thereof will be omitted. In the present embodiment, a one-way clutch is not provided in the drive gear 263, and a one-way clutch is not provided in the drive gear 265 either, the drive gear 263 and the drive gear 265 are linked to be rotated, and the ratchet configured to stop the rotation of the drive gear 265 is not provided.

Although the paper guide transfer means B includes an end fence 250 configured to hold the rear end portion of the paper and an end fence belt 251, engaging holes 251*a* are formed continuously at predetermined intervals in the end fence belt 251, and an engaging pin 250*a* is provided in the end fence 250. The engaging pin 250*a* is operated by the solenoid 250*b* and engages the engaging hole 251*a*, and the release of the engagement is performed. The end fence 250 becomes movable by the end fence belt 251 by the engaging pin 250*a* being engaged with the engaging hole 251*a*, and returns to the initial position by the spring 254 by the engagement being released.

Next, the operation of the paper grip transfer means A, the paper guide transfer means B, and the drive means C will be described. The end fence 250 provided in the paper guide transfer means B sets the position where the several sheets of paper housed on the paper stacking plate 205 are aligned as the initial position K1, and holds the rear end portion of the paper to stop in a state of being accurately aligned. In this state, the engaging pin 250*a* does not engage the engaging hole 251*a*, whereby the end fence 250 is made unmovable by the end fence belt 251.

When the single drive source 260 provided in the drive means C is driven, the rotation of the drive source 260 is transmitted to the first drive shaft 262 through the drive belt 261, and furthermore transmitted from the drive gear 263 to the drive gear 265, but the rotation of the drive gear 265 is stopped by the ratchet 266, and the second drive shaft 264 does not rotate. Therefore, the end fence 250 remains stopped by setting the position for gripping the paper as the initial position.

When the first drive shaft 262 rotates, this rotation is transmitted to the belt drive gear 272 through the grip drive gear 270 and the intermediate gear 271, the gripper belt 274 is driven by the drive roller 273 coaxially provided on the belt drive gear 272, and the gripper 106 reaches the predetermined position, the gripper position detecting means S1 detects the position of the gripper 106, and the gripper position detection information is transmitted to the controller 78.

The controller 278 controls the end fence drive solenoid 279 based on the gripper position detection information, the engaging pin 250*a* operates and engages the engaging hole 251*a*, the end fence 250 stopped in the initial position K1 is linked with the paper grip transfer means A to be transferred, and the gripper 106 and the end fence 250 are synchronized. The end fence 250 holds the rear end portion of the several sheets of paper to transfer to the gripping position K2 for gripping the paper by the paper grip transfer means A, the gripper 106 grips the paper in the gripping position K2 to transfer, and the end fence position detection information is transmitted from the end fence position detecting means S2 to the controller 278. The controller 278 controls the end fence drive solenoid 279 based on the end fence position detection information, the engaging pin 250*a* operates, the engagement of the engaging hole 251*a* is released, and by the engagement being released, the end fence 250 is returned to the initial position K1 by the spring 254, thereafter the gripper 106 can transfer and arrange the paper to stack on the stacker tray 103.

After the paper is arranged to be stacked on the stacker tray 103, When the next paper is housed in the paper stacking plate 205, the first drive shaft 262 and the second drive shaft 264 continue to rotate, whereby the gripper position detecting means S1 detects the position of the gripper 106 as described above, operated in the same manner as the gripper position detection information is transmitted to the controller 278, the next paper can be arranged on the stacker tray 103 to be stacked.

Thus, the paper guide transfer means B holds the paper by the paper grip transfer means A, holds the paper to transfer in synchronization with the paper grip transfer means A, and arranges the paper to stack on the stacker tray 103, and the Paper is not bent (turned up) even when the paper is in contact with the wall surface, and the paper can be transferred to be stacked on the stacker tray without being damaged and without being shifted.

The paper guide transfer means B includes the end fence 250 configured to hold the rear end portion of the paper, and the drive means C transfers the end fence 250 by linking with the paper grip transfer means A in the initial position K1, releases the linkage at the timing of gripping and transferring the paper by the paper grip transfer means A, or subsequently, and returns the end fence 250 to the initial position K1, whereby the several sheets of paper can be accurately aligned, gripped, and transferred in a simple structure.

In addition, the paper guide transfer means B are disposed on both sides of the paper grip transfer means A, whereby the several sheets of paper can be accurately aligned and transferred to the grip position, the several sheets of paper canbe accurately aligned, reliably gripped, and transferred in a simple and low-cost structure, and the paper can be accurately gripped and transferred to be stacked on the stacker tray without being damaged and without being shifted.

(Third Configuration of Paper Grip Transfer Means, Paper Guide Transfer Means, and Drive Means)

Figure 48:
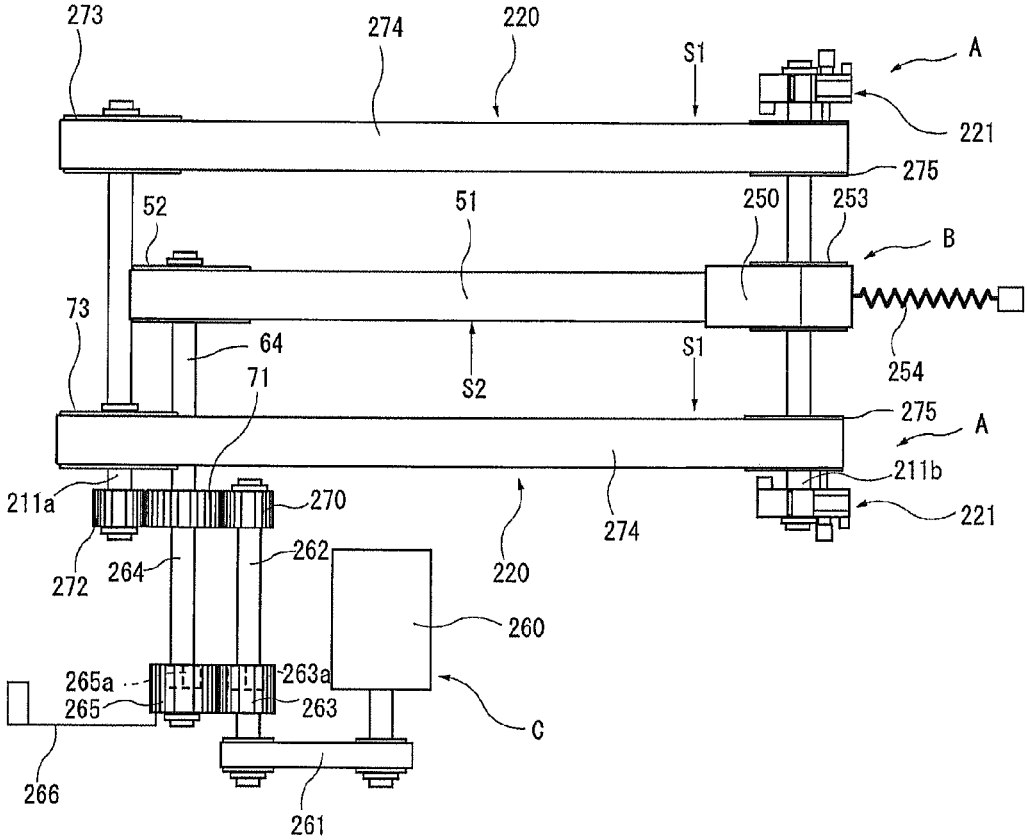
FIG. 48 is a plan view showing a third overall configuration.

The third configuration of the paper grip transfer means, the paper guide transfer means, and the drive means will be described with reference to FIG. 48. Although configured similarly to the first configuration, the present embodiment has a configuration of including a pair of paper grip transfer means A, of placing a paper guide transfer means B between the pair of paper grip transfer means A, and of transferring the paper by the paper grip transfer means A disposed on both sides and the paper guide transfer means B disposed in the middle.

A pair of paper grip transfer means A are included and the paper guide transfer means B is disposed between the pair of paper grip transfer means A, whereby the several sheets of paper can be accurately aligned and transferred to the grip position, the several sheets of paper can be accurately aligned, reliably gripped, and transferred in a simple and low-cost structure, and the paper can be accurately gripped on both sides of the paper and transferred to be stacked on the stacker tray without being damaged and without being shifted.

The present invention is not intended to be limited by the structure of the aforementioned drawings, and it will be apparent for a person who has a common knowledge in the technical field to which the invention pertains that various replacements, modifications, and changes can be performed within the scope of the technical ideas or the equivalents thereof of the present invention.

INDUSTRIAL APPLICABILITY

The present invention is applicable to a paper post-processing device that is coupled to the image-forming device such as a printer, a copying machine, and a printing machine, and performs the post-processing on the paper to be discharged from the image-forming device, and the paper post-processing device can reliably arrange the paper to be stacked on the stacker tray, and can perform a variety of paper post-processing functions at a high speed, and moreover, has a compact structure.

REFERENCE SIGNS LIST

1 image-forming device
102 paper post-processing device
103 stacker tray
104 compilation unit
105 and 115 jogger
106 gripper
107 stapler
108 discharge roller
109 inlet roller
112 base tray
113 extension guide
117 rear wall
122 paddle
50 and 51 slope
90 grip release means
91 release guide member
96 release lever
110 paper stacking device
120 transfer path
202 ejector
203 guide side plate
203*a* rail groove
203*b* curved-surface cam
205 paper stacking plate
206 transfer belt
207 drive motor
211*a* stacker tray-side rotating shaft
211*b* grip-side rotating shaft
212 fixed shaft
213 power transmission means
215 ejector plate
216 hinge portion
217 boss
218 spring
220 paper transfer means
221 paper grip means
222 drive means
224 paper alignment device
280 guide means
223 and 289 roller
Pa paper
Pb paper bundle
A paper grip transfer means
B paper guide transfer means
C drive means
X device main body
FIG. 28
SW1 PAPER DETECTION SENSOR
300 PAPER STACKING NUMBER OF SHEETS SETTING MEANS
301 PAPER SIZE SETTING MEANS
310 PAPER TRANSFER MEANS
311 JOGGER DRIVE MEANS
312 GRIPPER DRIVE MEANS
313 PADDLE DRIVE MEANS
314 EXTENSION TRAY DRIVE MEANS
400 CONTROLLER
FIG. 29
START
S21 PAPER SIZE SETTING
S22 PAPER STACKING NUMBER OF SHEETS SETTING
S23 START OF PAPER TRANSFER TO BASE TRAY 112
S24 DRIVE JOGGER 105 IS IN STANDBY POSITION.
S25 DISCHARGE ROLLER 108 IS ROTATED.
S26 EXTENSION GUIDE 113 IS ADVANCED, AND FRONT END OF PAPERBUNDLE PB DISCHARGED TO STACKER TRAY 103 IS MADE SUPPORTABLE.
S27 PAPER DETECTION SENSOR SW1 DETECTS FRONT END OF PAPER WITHIN PREDETERMINED TIME FROM PAPER TRANSFER START.
S28 JAM OR ERROR DISPLAY
S29 PAPER DETECTION SENSOR SW1 DETECTS REAR END OF PAPER WITHIN PREDETERMINED TIME.
S30 JAM OR ERROR DISPLAY
S31 PADDLE 122 IS ROTATED, AND DRIVE JOGGER 105 MOVES PREDETERMINED DISTANCE AND ALIGNS PAPER.
S32 LOADING OF SET NUMBER OF SHEETS OF PAPER ON BASE TRAY 112 IS COMPLETED.
S33 POST-PROCESSING ON PAPER BUNDLE PB IS PERFORMED.
S34 GRIPPER 106 STARTS ROTATING OPERATION.
S35 GRIPPER 106 STARTS EXTRUDING REAR END OF PAPER BUNDLE PB.
S36 EXTENSION GUIDE 113 RETREATS SO AS NOT TO DISTURB DISCHARGE OF PAPER BUNDLE PB.
S37 FOLLOWING PAPER PA IS LOADED INTO BASE TRAY 112.
S38 FRONT END OF FOLLOWING PAPER PA RIDES ON SLOPE OF DRIVE JOGGER 105 LOADED PRIOR TO GRIPPER 106 CONFIGURED TO EXTRUDE PRECEDING PAPER BUNDLE PB, OR ON GRIPPER 106. REAR END OF FOLLOWING PAPER IS POSITIONED BEHIND GRIPPER 106.
S39 EXTENSION GUIDE 113 RETREATS, AND PAPER BUNDLE PB IS DISCHARGED TO STACKER TRAY 103 BY GRIPPER 106.
S40 FOLLOWING PAPER PB IS LOADED.
S41 FOLLOWING PAPER REACHES POSITION OF INTERFERING WITH DRIVE JOGGER 105 IN A STATE WHERE DRIVE JOGGER 105 IS IN ALIGNMENT POSITION.

S42 FOLLOWING PAPER IS DISCHARGED SO THAT FRONT END OF FOLLOWING PAPER RIDES FROM SLOPE OF DRIVE JOGGER 105.

S43 DRIVE JOGGER 105 IS MOVED TO STANDBY POSITION.

S44 DRIVE JOGGER 105 IS MOVED TO STANDBY POSITION.

S45 FOLLOWING PAPER PA IS DISCHARGED ONTO BASE TRAY 112. END

FIG. 43

277 RATCHET DRIVE MEANS

278 CONTROLLER

S1 GRIPPER POSITION DETECTING MEANS

S2 END FENCE POSITION DETECTING MEANS

FIG. 46

277 RATCHET DRIVE MEANS

278 CONTROLLER

279 SOLENOID DRIVE MEANS

S1 GRIPPER POSITION DETECTING MEANS

S2 END FENCE POSITION DETECTING MEANS

The invention is claimed is:

1. A paper post-processing device comprising:

a base tray configured to stack paper transferred from an image-forming device;

a paper transferring unit including a paper grip transfer means configured to grip and transfer a rear end of a paper bundle stacked on the base tray, and to release a grip in a discharge position to stack the paper bundle on the stacker tray, and a paper guide transfer means configured to hold and transfer a rear end portion of several sheets of paper housed in the paper stacking plate;

a stacker tray configured to stack paper transferred from the paper transferring unit; and a drive means configured to link the paper grip transfer means and the paper guide transfer means to be driven by a single drive source, wherein the paper guide transfer means sets a position where the several sheets of paper housed on the paper stacking plate are aligned as an initial position to hold the paper, holds and transfers the rear end portion of the several sheets of paper to a grip position for gripping paper by the paper grip transfer means, and returns to the initial position at a timing of gripping and transferring the paper by the paper grip transfer means, or subsequently.

2. The paper post-processing device according to claim 1, wherein the paper guide transfer means is disposed on each side of the paper grip transfer means.

3. The paper post-processing device according to claim 1, comprising a pair of paper grip transfer means, wherein the paper guide transfer means is disposed between the pair of paper grip transfer means.

4. The paper post-processing device according to claim 1, wherein the paper guide transfer means includes an end fence configured to hold a rear end portion of paper, and the drive means transfers the end fence by linking with the paper grip transfer means in the initial position, releases the linkage at a timing of gripping and transferring the paper by the paper grip transfer means, or subsequently, and returns the end fence to the initial position.

* * * * *